US009583061B2

(12) United States Patent
Yamazaki et al.

(10) Patent No.: US 9,583,061 B2
(45) Date of Patent: Feb. 28, 2017

(54) DISPLAY DEVICE AND DRIVING METHOD

(75) Inventors: Shunpei Yamazaki, Tokyo (JP); Jun Koyama, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1521 days.

(21) Appl. No.: 13/022,879

(22) Filed: Feb. 8, 2011

(65) Prior Publication Data

US 2011/0199364 A1 Aug. 18, 2011

(30) Foreign Application Priority Data

Feb. 12, 2010 (JP) ..... 2010-029446

(51) Int. Cl.
*G09G 5/00* (2006.01)
*G09G 3/36* (2006.01)

(52) U.S. Cl.
CPC ..... *G09G 3/3655* (2013.01); *G09G 3/3648* (2013.01); *G09G 3/3688* (2013.01); *G09G 3/3614* (2013.01); *G09G 2310/0297* (2013.01); *G09G 2310/06* (2013.01); *G09G 2320/0214* (2013.01); *G09G 2320/0247* (2013.01); *G09G 2330/021* (2013.01)

(58) Field of Classification Search
CPC .. G09G 3/3648; G09G 3/3655; G09G 3/3688; G09G 2310/0297; G09G 2310/06; G09G 2320/0214; G09G 2320/0247; G09G 2330/021; G09G 3/3614
USPC ..... 345/55–103
See application file for complete search history.

(56) References Cited

U.S. PATENT DOCUMENTS 5,731,856 A 3/1998 Kim et al.
5,744,864 A 4/1998 Cillessen et al.
(Continued)

FOREIGN PATENT DOCUMENTS

CN 001220098 C 9/2005
CN 001685393 A 10/2005
(Continued)

OTHER PUBLICATIONS

International Search Report (International Patent Application No. PCT/JP2011/051375) dated Mar. 15, 2011.
(Continued)

*Primary Examiner* — Amare Mengistu
*Assistant Examiner* — Stacy Khoo
(74) *Attorney, Agent, or Firm* — Fish & Richardson P.C.

(57) ABSTRACT

An object is to reduce power consumption of a display device and to suppress deterioration of display quality. As a transistor provided for each pixel, a transistor including an oxide semiconductor layer is used. Note that off-state current of the transistor can be decreased when the oxide semiconductor layer is highly purified. Therefore, variation in the value of a data signal due to the off-state current of the transistor can be suppressed. That is, display deterioration (change) which occurs when writing frequency of the data signal to the pixel including the transistor is reduced (when a break period is lengthened) can be suppressed. In addition, flickers in display which generates when the frequency of an alternating-current driving signal supplied to a signal line in the break period is reduced can be suppressed.

13 Claims, 14 Drawing Sheets

(56) References Cited

U.S. PATENT DOCUMENTS

| | | | | |
|---|---|---|---|---|
| 5,923,320 | A * | 7/1999 | Murakami et al. | 345/179 |
| 6,294,274 | B1 | 9/2001 | Kawazoe et al. | |
| 6,563,174 | B2 | 5/2003 | Kawasaki et al. | |
| 6,727,522 | B1 | 4/2004 | Kawasaki et al. | |
| 6,751,745 | B1 * | 6/2004 | Yoshimura et al. | 713/501 |
| 7,049,190 | B2 | 5/2006 | Takeda et al. | |
| 7,061,014 | B2 | 6/2006 | Hosono et al. | |
| 7,064,346 | B2 | 6/2006 | Kawasaki et al. | |
| 7,105,868 | B2 | 9/2006 | Nause et al. | |
| 7,211,825 | B2 | 5/2007 | Shih et al | |
| 7,282,782 | B2 | 10/2007 | Hoffman et al. | |
| 7,286,108 | B2 | 10/2007 | Tsuda et al. | |
| 7,297,977 | B2 | 11/2007 | Hoffman et al. | |
| 7,321,353 | B2 | 1/2008 | Tsuda et al. | |
| 7,323,356 | B2 | 1/2008 | Hosono et al. | |
| 7,361,934 | B2 | 4/2008 | Ishii | |
| 7,385,224 | B2 | 6/2008 | Ishii et al. | |
| 7,402,506 | B2 | 7/2008 | Levy et al. | |
| 7,411,209 | B2 | 8/2008 | Endo et al. | |
| 7,453,065 | B2 | 11/2008 | Saito et al. | |
| 7,453,087 | B2 | 11/2008 | Iwasaki | |
| 7,462,862 | B2 | 12/2008 | Hoffman et al. | |
| 7,468,304 | B2 | 12/2008 | Kaji et al. | |
| 7,477,223 | B2 | 1/2009 | Sekiguchi et al. | |
| 7,501,293 | B2 | 3/2009 | Ito et al. | |
| 7,674,650 | B2 | 3/2010 | Akimoto et al. | |
| 7,732,819 | B2 | 6/2010 | Akimoto et al. | |
| 7,906,777 | B2 | 3/2011 | Yano et al. | |
| 7,924,276 | B2 | 4/2011 | Tsuda et al. | |
| 8,129,714 | B2 | 3/2012 | Yano et al. | |
| 8,461,583 | B2 | 6/2013 | Yano et al. | |
| 8,513,662 | B2 | 8/2013 | Yabuta et al. | |
| 8,723,175 | B2 | 5/2014 | Yano et al. | |
| 8,791,457 | B2 | 7/2014 | Yano et al. | |
| 9,249,032 | B2 | 2/2016 | Inoue et al. | |
| 2001/0046027 | A1 | 11/2001 | Tai et al. | |
| 2002/0036636 | A1 | 3/2002 | Yanagi et al. | |
| 2002/0056838 | A1 | 5/2002 | Ogawa | |
| 2002/0132454 | A1 | 9/2002 | Ohtsu et al. | |
| 2003/0189401 | A1 | 10/2003 | Kido et al. | |
| 2003/0218222 | A1 | 11/2003 | Wager et al. | |
| 2004/0038446 | A1 | 2/2004 | Takeda et al. | |
| 2004/0113879 | A1 | 6/2004 | Sekiguchi et al. | |
| 2004/0127038 | A1 | 7/2004 | Carcia et al. | |
| 2005/0017302 | A1 | 1/2005 | Hoffman | |
| 2005/0083084 | A1 | 4/2005 | Aota et al. | |
| 2005/0140632 | A1 | 6/2005 | Tsuda et al. | |
| 2005/0199959 | A1 | 9/2005 | Chiang et al. | |
| 2006/0035452 | A1 | 2/2006 | Carcia et al. | |
| 2006/0043377 | A1 | 3/2006 | Hoffman et al. | |
| 2006/0091793 | A1 | 5/2006 | Baude et al. | |
| 2006/0108529 | A1 | 5/2006 | Saito et al. | |
| 2006/0108636 | A1 | 5/2006 | Sano et al. | |
| 2006/0110867 | A1 | 5/2006 | Yabuta et al. | |
| 2006/0113536 | A1 | 6/2006 | Kumomi et al. | |
| 2006/0113539 | A1 | 6/2006 | Sano et al. | |
| 2006/0113549 | A1 | 6/2006 | Den et al. | |
| 2006/0113565 | A1 | 6/2006 | Abe et al. | |
| 2006/0169973 | A1 | 8/2006 | Isa et al. | |
| 2006/0170111 | A1 | 8/2006 | Isa et al. | |
| 2006/0197092 | A1 | 9/2006 | Hoffman et al. | |
| 2006/0208977 | A1 | 9/2006 | Kimura | |
| 2006/0228974 | A1 | 10/2006 | Thelss et al. | |
| 2006/0231882 | A1 | 10/2006 | Kim et al. | |
| 2006/0238135 | A1 | 10/2006 | Kimura | |
| 2006/0244107 | A1 | 11/2006 | Sugihara | |
| 2006/0284171 | A1 | 12/2006 | Levy et al. | |
| 2006/0284172 | A1 | 12/2006 | Ishii | |
| 2006/0292777 | A1 | 12/2006 | Dunbar | |
| 2007/0024187 | A1 | 2/2007 | Shin et al. | |
| 2007/0046191 | A1 | 3/2007 | Saito | |
| 2007/0052025 | A1 | 3/2007 | Yabuta | |
| 2007/0054507 | A1 | 3/2007 | Kaji et al. | |
| 2007/0090365 | A1 | 4/2007 | Hayashi et al. | |
| 2007/0108446 | A1 | 5/2007 | Akimoto | |
| 2007/0152217 | A1 | 7/2007 | Lai et al. | |
| 2007/0172591 | A1 | 7/2007 | Seo et al. | |
| 2007/0187678 | A1 | 8/2007 | Hirao et al. | |
| 2007/0187760 | A1 | 8/2007 | Furuta et al. | |
| 2007/0194379 | A1 | 8/2007 | Hosono et al. | |
| 2007/0252928 | A1 | 11/2007 | Ito et al. | |
| 2007/0272922 | A1 | 11/2007 | Kim et al. | |
| 2007/0287296 | A1 | 12/2007 | Chang | |
| 2008/0006877 | A1 | 1/2008 | Mardilovich et al. | |
| 2008/0038882 | A1 | 2/2008 | Takechi et al. | |
| 2008/0038929 | A1 | 2/2008 | Chang | |
| 2008/0050595 | A1 | 2/2008 | Nakagawara et al. | |
| 2008/0055218 | A1 | 3/2008 | Tsuda et al. | |
| 2008/0073653 | A1 | 3/2008 | Iwasaki | |
| 2008/0083950 | A1 | 4/2008 | Pan et al. | |
| 2008/0106191 | A1 | 5/2008 | Kawase | |
| 2008/0128689 | A1 | 6/2008 | Lee et al. | |
| 2008/0129195 | A1 | 6/2008 | Ishizaki et al. | |
| 2008/0166834 | A1 | 7/2008 | Kim et al. | |
| 2008/0180385 | A1 | 7/2008 | Yoshida et al. | |
| 2008/0182358 | A1 | 7/2008 | Cowdery-Corvan et al. | |
| 2008/0224133 | A1 | 9/2008 | Park et al. | |
| 2008/0254569 | A1 | 10/2008 | Hoffman et al. | |
| 2008/0258139 | A1 | 10/2008 | Ito et al. | |
| 2008/0258140 | A1 | 10/2008 | Lee et al. | |
| 2008/0258141 | A1 | 10/2008 | Park et al. | |
| 2008/0258143 | A1 | 10/2008 | Kim et al. | |
| 2008/0296568 | A1 | 12/2008 | Ryu et al. | |
| 2009/0068773 | A1 | 3/2009 | Lai et al. | |
| 2009/0073325 | A1 | 3/2009 | Kuwabara et al. | |
| 2009/0114910 | A1 | 5/2009 | Chang | |
| 2009/0134399 | A1 | 5/2009 | Sakakura et al. | |
| 2009/0152506 | A1 | 6/2009 | Umeda et al. | |
| 2009/0152541 | A1 | 6/2009 | Maekawa et al. | |
| 2009/0166616 | A1 | 7/2009 | Uchiyama | |
| 2009/0278122 | A1 | 11/2009 | Hosono et al. | |
| 2009/0280600 | A1 | 11/2009 | Hosono et al. | |
| 2010/0065844 | A1 | 3/2010 | Tokunaga | |
| 2010/0092800 | A1 | 4/2010 | Itagaki et al. | |
| 2010/0109002 | A1 | 5/2010 | Itagaki et al. | |
| 2010/0140614 | A1 * | 6/2010 | Uchiyama et al. | 257/43 |

FOREIGN PATENT DOCUMENTS

| | | | |
|---|---|---|---|
| EP | 1 296 174 | A1 | 3/2003 |
| EP | 1 737 044 | A1 | 12/2006 |
| EP | 2 226 847 | A2 | 9/2010 |
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 03-114030 | A | 5/1991 |
| JP | 05-251705 | A | 9/1993 |
| JP | 08-264794 | A | 10/1996 |
| JP | 09-243996 | A | 9/1997 |
| JP | 11-505377 | A | 5/1999 |
| JP | 2000-044236 | A | 2/2000 |
| JP | 2000-150900 | A | 5/2000 |
| JP | 2002-076356 | A | 3/2002 |
| JP | 2002-182619 | A | 6/2002 |
| JP | 2002-289859 | A | 10/2002 |
| JP | 2003-086000 | A | 3/2003 |
| JP | 2003-086808 | A | 3/2003 |
| JP | 2004-103957 | A | 4/2004 |
| JP | 2004-206075 | A | 7/2004 |
| JP | 2004-273614 | A | 9/2004 |
| JP | 2004-273732 | A | 9/2004 |
| JP | 2006-343612 | A | 12/2006 |
| JP | 2007-142196 | A | 6/2007 |
| JP | 2009-158663 | A | 7/2009 |
| JP | 2009-276387 | A | 11/2009 |
| JP | 2010-016163 | A | 1/2010 |
| TW | 200901528 | | 1/2009 |
| WO | 2004/040544 | A1 | 5/2004 |
| WO | 2004/114391 | A1 | 12/2004 |
| WO | WO-2006/132392 | | 12/2006 |

(56) References Cited

FOREIGN PATENT DOCUMENTS

| | | |
|---|---|---|
| WO | WO-2008/139860 | 11/2008 |
| WO | WO-2009/081885 | 7/2009 |
| WO | WO-2009/139483 | 11/2009 |

OTHER PUBLICATIONS

Written Opinion (International Patent Application No. PCT/JP2011/051375) dated Mar. 15, 2011.
Asakuma, N et al., "Crystallization and Reduction of Sol-Gel-Derived Zinc Oxide Films by Irradiation With Ultraviolet Lamp," Journal of Sol-Gel Science and Technology, 2003, vol. 26, pp. 181-184.
Asaoka, Y et al., "29.1: Polarizer-Free Reflective LCD Combined With Ultra Low-Power Driving Technology," SID Digest '09 : SID International Symposium Digest of Technical Papers, 2009, pp. 395-398.
Chern, H et al., "An Analytical Model for the Above-Threshold Characteristics of Polysilicon Thin-Film Transistors," IEEE Transactions on Electron Devices, Jul. 1, 1995, vol. 42, No. 7, pp. 1240-1246.
Cho, D et al., "21.2: Al and Sn-Doped Zinc Indium Oxide Thin Film Transistors for AMOLED Back-Plane," SID Digest '09 : SID International Symposium Digest of Technical Papers, May 31, 2009, pp. 280-283.
Clark, S et al. "First Principles Methods Using CASTEP," Zeitschrift fur Kristallographie, 2005, vol. 220, pp. 567-570.
Coates. D et al., "Optical Studies of the Amorphous Liquid-Cholesteric Liquid Crystal Transition: The Blue Phase," Physics Letters, Sep. 10, 1973, vol. 45A, No. 2, pp. 115-116.
Costello, M et al., "Electron Microscopy of a Cholesteric Liquid Crystal and its Blue Phase," Phys. Rev. A (Physical Review. A), May 1, 1984, vol. 29, No. 5, pp. 2957-2959.
Dembo, H et al., "RFCPUS on Glass and Plastic Substrates Fabricated by TFT Transfer Technology," IEDM 05: Technical Digest of International Electron Devices Meeting, Dec. 5, 2005, pp. 1067-1069.
Fortunato, E et al., "Wide-Bandgap High-Mobility ZnO Thin-Film Transistors Produced at Room Temperature," Appl. Phys. Lett. (Applied Physics Letters), Sep. 27, 2004, vol. 85, No. 13, pp. 2541-2543.
Fung, T et al., "2-D Numerical Simulation of High Performance Amorphous In—Ga—Zn—O TFTs for Flat Panel Displays," AM-FPD '08 Digest of Technical Papers, Jul. 2, 2008, pp. 251-252, The Japan Society of Applied Physics.
Godo, H et al., "P-9: Numerical Analysis on Temperature Dependence of Characteristics of Amorphous In-Ga-Zn-Oxide TFT," SID Digest 09 : SID International Symposium Digest of Technical Papers, May 31, 2009, pp. 1110-1112.
Godo, H et al., "Temperature Dependence of Characteristics and Electronic Structure for Amorphous In-Ga-Zn-Oxide TFT," AM-FPD '09 Digest of Technical Papers, Jul. 1, 2009, pp. 41-44.
Hayashi, R et al., "42.1: Invited Paper: Improved Amorphous In—Ga—Zn—O TFTS," SID Digest '08 : SID International Symposium Digest of Technical Papers, May 20, 2008, vol. 39, pp. 621-624.
Hirao, T et al., "Novel Top-Gate Zinc Oxide Thin-Film Transistors (ZnO TFTS) for AMLCDS," Journal of the SID , 2007, vol. 15, No. 1, pp. 17-22.
Hosono, H et al., "Working hypothesis to explore novel wide band gap electrically conducting amorphous oxides and examples," J. Non-Cryst. Solids (Journal of Non-Crystalline Solids), 1996, vol. 198-200, pp. 165-169.
Hosono, H, "68.3: Invited Paper:Transparent Amorphous Oxide Semiconductors for High Performance TFT," SID Digest '07 : SID International Symposium Digest of Technical Papers, 2007, vol. 38, pp. 1830-1833.
Hsieh, H et al., "P-29: Modeling of Amorphous Oxide Semiconductor Thin Film Transistors and Subgap Density of States," SID Digest '08 : SID International Symposium Digest of Technical Papers, 2008, vol. 39, pp. 1277-1280.
Ikeda., T et al., "Full-Functional System Liquid Crystal Display Using Cg-Silicon Technology," SID Digest '04 : SID International Symposium Digest of Technical Papers, 2004, vol. 35, pp. 860-863.
Janotti, A et al., "Native Point Defects in ZnO," Phys. Rev. B (Physical Review. B), 2007, vol. 76, No. 16, pp. 165202-1-165202-22.
Janotti, A et al., "Oxygen Vacancles in ZnO," Appl. Phys. Lett. (Applied Physics Letters), 2005, vol. 87, pp. 122102-1-122102-3.
Jeong, J et al., "3.1: Distinguished Paper: 12.1-Inch WXGA AMOLED Display Driven by Indium-Gallium-Zinc Oxide TFTs Array," SID Digest '08 : SID International Symposium Digest of Technical Papers, May 20, 2008, vol. 39, No. 1, pp. 1-4.
Jin, D et al., "65.2: Distinguished Paper:World-Largest (6.5") Flexible Full Color Top Emission AMOLED Display on Plastic Film and its Bending Properties," SID Digest '09 : SID International Symposium Digest of Technical Papers, May 31, 2009, pp. 983-985.
Kanno, H et al., "White Stacked Electrophosphorecent Organic Light-Emitting Devices Employing MOO3 as a Charge-Generation Layer," Adv. Mater. (Advanced Materials), 2006, vol. 18, No. 3, pp. 339-342.
Kikuchi, H et al., "39.1: Invited Paper: Optically Isotropic Nano-Structured Liquid Crystal Composites for Display Applications," SID Digest '09 : SID International Symposium Digest of Technical Papers, May 31, 2009, pp. 578-581.
Kikuchi, H et al., "62.2: Invited Paper: Fast Electro-Optical Switching in Polymer-Stabilized Liquid Crystalline Blue Phases for Display Application," SID Digest '07 : SID International Symposium Digest of Technical Papers, 2007, vol. 38, pp. 1737-1740.
Kikuchi, H et al., "Polymer-Stabilized Liquid Crystal Blue Phases,", Nature Materials, Sep. 1, 2002, vol. 1, pp. 64-68.
Kim, S et al., "High-Performance oxide thin film transistors passivated by various gas plasmas," The Electrochemical Society, 214th ECS Meeting, 2008, No. 2317, 1 page.
Kimizuka, N et al., "Spinel, YbFe2O4, and Yb2Fe3O7 Types of Structures for Compounds in the In2O3 and Sc2O3—A2O3—Bo Systems [A; Fe, Ga, or Al; B: Mg, Mn, Fe, Ni, Cu,or Zn] at Temperatures Over 1000° C.," Journal of Solid State Chemistry, 1985, vol. 60, pp. 382-384.
Kimizuka, N et al., "Syntheses and Single-Crystal Data of Homologous Compounds, In2O3(ZnO)m (m=3, 4, and 5), InGaO3(ZnO)3, and Ga2O3(ZnO)m (m=7, 8, 9, and 16) in the In2O3—ZnGa2O4—ZnO System," Journal of Solid State Chemistry, Apr. 1, 1995, vol. 116, No. 1, pp. 170-178.
Kitzerow, H et al., "Observation of Blue Phases in Chiral Networks," Liquid Crystals, 1993, vol. 14, No. 3, pp. 911-916.
Kurokawa, Y et al., "UHF RFCPUS on Flexible and Glass Substrates for Secure RFID Systems," Journal of Solid-State Circuits , 2008, vol. 43, No. 1, pp. 292-299.
Lany, S et al., "Dopability, Intrinsic Conductivity, and Nonstoichiometry of Transparent Conducting Oxides," Phys. Rev. Lett. (Physical Review Letters), Jan. 26, 2007, vol. 98, pp. 045501-1-045501-4.
Lee, H et al., "Current Status of, Challenges to, and Perspective View of AM-OLED," IDW '06 : Proceedings of the 13th International Display Workshops, Dec. 7, 2006, pp. 663-666.
Lee, J et al., "World's Largest (15-Inch) XGA AMLCD Panel Using IGZO Oxide TFT," SID Digest '08 : SID International Symposium Digest of Technical Papers, May 20, 2008, vol. 39, pp. 625-628.
Lee, M et al., "15.4: Excellent Performance of Indium-Oxide-Based Thin-Film Transistors by DC Sputtering," SID Digest '09 : SID International Symposium Digest of Technical Papers, May 31, 2009, pp. 191-193.
Li, C et al., "Modulated Structures of Homologous Compounds InMO3(ZnO)m (M=In,Ga; m=Integer) Described by Four-Dimensional Superspace Group," Journal of Solid State Chemistry, 1998, vol. 139, pp. 347-355.
Masuda, S et al., "Transparent thin film transistors using ZnO as an active channel layer and their electrical properties," J. Appl. Phys. (Journal of Applied Physics), Feb. 1, 2003, vol. 93, No. 3, pp. 1624-1630.

(56) References Cited

OTHER PUBLICATIONS

Meiboom, S et al., "Theory of the Blue Phase of Cholesteric Liquid Crystals," Phys. Rev. Lett. (Physical Review Letters), May 4, 1981, vol. 46, No. 18, pp. 1216-1219.
Miyasaka M, "SUFTLA Flexible Microelectronics on Their Way to Business," SID Digest '07 : SID International Symposium Digest of Technical Papers, 2007, vol. 38, pp. 1673-1676.
Mo, Y et al., "Amorphous Oxide TFT Backplanes for Large Size AMOLED Displays," IDW '08 : Proceedings of the 6th International Display Workshops, Dec. 3, 2008, pp. 581-584.
Nakamura, "Synthesis of Homologous Compound with New Long-Period Structure," NIRIM Newsletter, Mar. 1995, vol. 150, pp. 1-4 with English translation.
Nakamura, M et al., "The phase relations in the In2O3—Ga2ZnO4—ZnO system at 1350° C.," Journal of State Chemistry, Aug. 1, 1991, vol. 93, pp. 298-315.
Nomura, K et al., "Thin-Film Transistor Fabricated in Single-Crystalline Transparent Oxide Semiconductor," Science, May 23, 2003, vol. 300, No. 5623, pp. 1269-1272.
Nomura, K et al., "Amorphous Oxide Semiconductors for High-Performance Flexible Thin-Film Transistors," Jpn. J. Appl. Phys. (Japanese Journal of Applied Physics) , 2006, vol. 45, No. 5B, pp. 4303-4308.
Nomura, K et al., "Room-Temperature Fabrication of Transparent Flexible Thin-Film Transistors Using Amorphous Oxide Semiconductors," Nature, Nov. 25, 2004, vol. 432, pp. 488-492.
Nomura, K et al., "Carrier transport in transparent oxide semiconductor with intrinsic structural randomness probed using single-crystalline InGaO3(ZnO)5 films," Appl. Phys. Lett. (Applied Physics Letters) , Sep. 13, 2004, vol. 85, No. 11, pp. 1993-1995.
Nowatari, H et al., "60.2: Intermediate Connector With Suppressed Voltage Loss for White Tandem OLEDS," SID Digest '09 : SID International Symposium Digest of Technical Papers, May 31, 2009, vol. 40, pp. 899-902.
Oba, F et al., "Defect eneregetics in ZnO: A hybrid Hartree-Fock density functional study," Phys. Rev. B (Physical Review. B), 2008, vol. 77, pp. 245202-1-245202-6.
Oh, M et al., "Improving the Gate Stability of ZnO Thin-Film Transistors With Aluminum Oxide Dielectric Layers," J. Electrochem. Soc. (Journal of the Electrochemical Society), 2008, vol. 155, No. 12, pp. H1009-H1014.
Ohara, H et al., "21.3: 4.0 In. QVGA AMOLED Display Using In-Ga-Zn-Oxide TFTS With a Novel Passivation Layer," SID Digest '09 : SID International Symposium Digest of Technical Papers, May 31, 2009, pp. 284-287.
Ohara, H et al., "Amorphous In-Ga-Zn-Oxide TFTs with Suppressed Venation for 4.0 inch QVGA AMOLED Display," AM-FPD '09 Digest of Technical Papers, Jul. 1, 2009, pp. 227-230, The Japan Society of Applied Physics.
Orita, M et al., "Amorphous transparent conductive oxide InGaO3(ZnO)m (m<4):a Zn4s conductor," Philosophical Magazine, 2001, vol. 81, No. 5, pp. 501-515.
Orita, M et al., "Mechanism of Electrical Conductivity of Transparent InGaZnO4," Phys. Rev. B (Physical Review. B), Jan. 15, 2000, vol. 61, No. 3, pp. 1811-1816.
Osada, T et al., "15.2: Development of Driver-Integrated Panel using Amorphous In-Ga-Zn-Oxide TFT," SID Digest '09 : SID International Symposium Digest of Technical Papers, May 31, 2009, pp. 184-187.
Osada, T et al., "Development of Driver-Integrated Panel Using Amorphous In-Ga-Zn-Oxide TFT," AM-FPD '09 Digest of Technical Papers, Jul. 1, 2009, pp. 33-36.
Park, J et al., "Dry etching of ZnO films and plasma-induced damage to optical properties," J. Vac. Sci. Technol. B (Journal of Vacuum Science & Technology B), Mar. 1, 2003, vol. 21, No. 2, pp. 800-803.
Park, J et al., "Improvements in the Device Characteristics of Amorphous Indium Gallium Zinc Oxide Thin-Film Transistors by Ar Plasma Treatment," Appl. Phys. Lett (Appued Physics Letters), Jun. 26, 2007, vol. 90, No. 26, pp. 262106-1-262106-3.
Park, J et al., "Electronic Transport Properties of Amorphous Indium-Gallium-Zinc Oxide Semiconductor Upon Exposure to Water," Appl. Phys. Lett. (Applied Physics Letters), 2008, vol. 92, pp. 072104-1-072104-3.
Park, J et al., "High performance amorphous oxide thin film transistors with self-aligned top-gate structure," IEDM 09: Technical Digest of International Electron Devices Meeting, Dec. 7, 2009, pp. 191-194.
Park, Sang-Hee et al., "42.3: Transparent ZnO Thin Film Transistor for the Application of High Aperture Ratio Bottom Emission AM-OLED Display," SID Digest '08 : SID International Symposium Digest of Technical Papers, May 20, 2008, vol. 39, pp. 629-632.
Park, J et al., "Amorphous Indium-Gallium-Zinc Oxide TFTS and Their Application for Large Size AMOLED," AM-FPD '08 Digest of Technical Papers, Jul. 2, 2008, pp. 275-278.
Park, S et al., "Challenge to Future Displays: Transparent AM-OLED Driven by PEALD Grown ZnO TFT," IMID '07 Digest, 2007, pp. 1249-1252.
Prins, M et al., "A Ferroelectric Transparent Thin-Film Transistor," Appl. Phys. Lett. (Applied Physics Letters), Jun. 17, 1996, vol. 68, No. 25, pp. 3650-3652.
Sakata, J et al., "Development of 4.0-In. AMOLED Display With Driver Circuit Using Amorphous In-Ga-Zn-Oxide TFTS," IDW '09 : Proceedings of the 16th International Display Workshops, 2009, pp. 689-692.
Son, K et al., "42.4L: Late-News Paper: 4 Inch QVGA AMOLED Driven by the Threshold Voltage Controlled Amorphous GIZO (Ga2O3—In2O3—ZnO) TFT," SID Digest '08 : SID International Symposium Digest of Technical Papers, May 20, 2008, vol. 39, pp. 633-636.
Takahashi, M et al., "Theoretical Analysis of IGZO Transparent Amorphous Oxide Semiconductor" IDW '08 : Proceedings of the 15th International Display Workshops, Dec. 3, 2008, pp. 1637-1640.
Tsuda, K et al., "Ultra Low Power Consumption Technologies for Mobile TFT-LCDs," IDW '02 : Proceedings of the 9th International Display Workshops, Dec. 4, 2002, pp. 295-298.
Ueno, K et al., "Field-Effect Transistor on SrTiO3 With Sputtered Al2O3 Gate Insulator," Appl. Phys. Lett. (Applied Physics Letters), Sep. 1, 2003, vol. 83, No. 9, pp. 1755-1757.
Van De Walle, C, "Hydrogen as a Cause of Doping in Zinc Oxide," Phys. Rev. Lett. (Physical Review Letters), Jul. 31, 2000, vol. 85, No. 5, pp. 1012-1015.
Taiwanese Office Action (Application No. 100104280) Dated Sep. 3, 2015.
Chinese Office Action (Application No. 201180009087.3) Dated Apr. 24, 2015.
Chinese Office Action (Application No. 201180009087.3) Dated Sep. 3, 2014.

* cited by examiner

DISPLAY DEVICE AND DRIVING METHOD

TECHNICAL FIELD

The present invention relates to a display device. In particular, the present invention relates to an active matrix display device.

BACKGROUND ART

Active matrix display devices having a plurality of pixels arranged in a matrix have been in widespread use. In general, the pixel includes a transistor, a scan line electrically connected to a gate of the transistor, a signal line electrically connected to one of a source and a drain of the transistor. The transistor is turned on by controlling a potential of the scan line, and a potential of the signal line is controlled so as to be a data signal to the pixel. Accordingly, a desired data signal can be supplied to a desired pixel. The display device displays images by performing such an operation successively to each pixel. At present, display of a display device is generally written 60 times per second (60 Hz). That is, a data signal is generally input (rewritten) once about every 0.0167 seconds.

In recent years, concern for the global environment has been increased and development of low-power-consumption display devices has been attracting attention. For example, a technique in which power consumption of a display device is reduced by decreasing rewriting frequency of display of the display device is disclosed in Patent Document 1. A specific structure of the display device disclosed in Patent Document 1 is described below.

In the display device disclosed in Patent Document 1, a scanning period in which one screen is scanned and a break period which follows the scanning period and is longer than the scanning period are set. In the Patent Document 1, the following technique is disclosed: in the break period, a potential of a scan line is fixed to a non-selection signal, and a potential of a signal line is (1) set at a fixed potential, (2) set at a fixed potential and then brought into a floating state, or (3) used as all alternating-current driving signal which is equal to or lower than the frequency of a data signal. Thus, power consumption in accordance with variation in the potential of the signal line in the break period is reduced. In addition, in the case where the potential of the signal line is used as an alternating-current driving signal which is equal to or lower than the frequency of the data signal (in the case of (3)) in the break period, variation in a potential of the pixel electrode caused by capacitive coupling between the signal line and the pixel electrode can be almost constant in the scanning period and the break period.

REFERENCE

[Patent Document 1] Japanese Patent Laid-Open No. 2002-182619

DISCLOSURE OF INVENTION

In the case where the signal line is supplied with an alternating-current driving signal which is equal to or lower than the frequency of the data signal in the break period (in the case of (3)), a long break period and a low frequency of the driving signal are effective in reducing power consumption. However, depending on the length of the break period and the frequency of the driving signal, display quality is likely to deteriorate in proportion to the value of off-state current of transistors provided for each pixel.

Firstly, the long break period means a transistor provided for the pixel is kept turned off for a long period of time while the data signal is held in each pixel. Thus, the value of the data signal varies according to off-state current of the transistor, whereby display quality of each pixel is likely to deteriorate (change).

In addition, the driving signal is an alternating-current signal as mentioned above. Therefore, the potential of the signal line may be higher than that of the data signal included in a specific pixel in a period corresponding to a specific half cycle of the driving signal, and the potential of the signal line may be lower than that of the data signal included in the specific pixel in a period corresponding to a half cycle following the aforementioned half cycle. In that case, it can be described that with the off-state current generated in the transistor provided for the pixel, the potential of the pixel electrode is increased by $\Delta V1$ in the period corresponding to the former half cycle, and the potential of the pixel electrode is decreased by $\Delta V2$ in the period corresponding to the latter half cycle. Here, the values of $\Delta V1$ and $\Delta V2$ are proportional to the length of the half cycles. That is, decrease in the frequency of the driving signal means that variation in the signal held in the pixel is increased. Therefore, the value of the data signal varies according to off-state current of the transistor, whereby flickers in display of each pixel is likely to be generated.

Thus, an object of an embodiment of the present invention is to reduce power consumption of a display device and to suppress deterioration of display quality.

The above object can be achieved by using, as a transistor provided for each pixel, a transistor including an oxide semiconductor layer. Note that the oxide semiconductor layer is an oxide semiconductor layer which is highly purified by thoroughly removing impurities (hydrogen, water, or the like) to be electron suppliers (donors). Further, the highly purified oxide semiconductor has very few carriers (close to zero) which are derived from hydrogen, oxygen deficiency, and the like and the carrier density is less than $1\times10^{12}/cm^3$, preferably less than $1\times10^{11}/cm^3$. In other words, the density of carriers derived from hydrogen, oxygen deficiency, and the like in the oxide semiconductor layer is made as close to zero as possible. Since the oxide semiconductor layer includes few carriers derived from hydrogen, oxygen deficiency, and the like, the amount of off-state current can be small when the transistor is turned off.

One embodiment of the present invention is a display device which includes a signal line to which a data signal is supplied in a scanning period in which one screen is scanned and an alternating-current driving signal having a lower frequency than the data signal is supplied in a break period which follows the scanning period and is longer than the scanning period; a scan line to which a selection signal is supplied in one horizontal scanning period included in the scanning period and a non-selection signal is supplied in periods other than the one horizontal scanning period; and a pixel provided with a transistor which has a gate electrically connected to the scan line and one of a source and a drain electrically connected to the signal line and which includes an oxide semiconductor layer In a display device according to one embodiment of the present invention, as a transistor provided for each pixel, a transistor including an oxide semiconductor layer is used. Note that the off-state current of the transistor can be decreased in the case where the oxide semiconductor layer is highly purified. Therefore, variation in the value of the data signal due to the off-state current of the transistor can be suppressed. That is to say, display deterioration (change) which occurs when the writing frequency of the data signal to the pixel including the transistor is reduced (when a break period is long) can be suppressed. In addition, flickers in display which generates when the frequency of an alternating-current driving signal is reduced can be suppressed.

BEST MODE FOR CARRYING OUT THE INVENTION

Hereinafter, embodiments of the present invention will be described in detail with reference to the accompanying drawings. Note that the present invention is not limited to the description below, and it is easily understood by those skilled in the art that a variety of changes and modifications can be made without departing from the spirit and scope of the present invention. Therefore, the present invention should not be limited to the descriptions of the embodiment modes and the embodiment below.

(Example of Active Matrix Display Device)

First, an example of an active matrix display device will be described. Specifically, an example of an active matrix liquid crystal display device having a scanning period in which one screen is scanned and a break period which follows the scanning period and is longer than the scanning period will be described with reference to FIGS. 1A to 1C, FIG. 2, FIG. 3, FIG. 4, FIGS. 5A to 5C, and FIG. 6. Specifically, the scanning period is a period where input of a data signal is performed once to a plurality of pixels arranged in matrix, and the break period is a period in which input of a data signal is not performed to the plurality of pixels arranged in matrix.

Figure 1A:
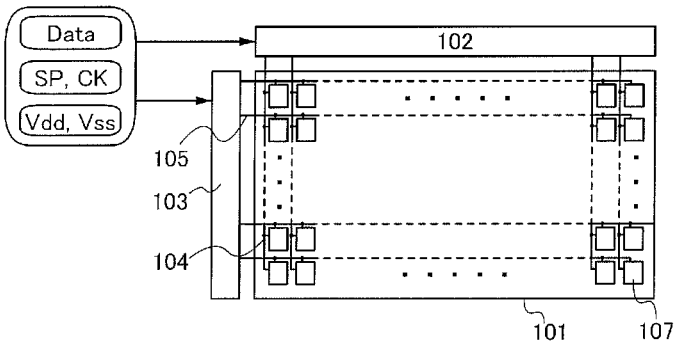
FIGS. 1A to 1C are (A) a view illustrating a structure of a display device, (B) a circuit diagram of a pixel, and (C) a cross-sectional view illustrating an example of a transistor provided for a pixel.

FIG. 1A illustrates a structure example of an active matrix display device. The display device illustrated in FIG. 1A includes a pixel portion 101, a signal line driver circuit 102, a scan line driver circuit 103, a plurality of signal lines 104 which are arranged in parallel or approximately parallel to each other and whose potential is controlled by the signal line driver circuit 102, and a plurality of scan lines 105 which are arranged in parallel or approximately parallel to each other and whose potential is controlled by the scan line driver circuit 103. The pixel portion 101 includes a plurality of pixels 107. Note that the plurality of pixels 107 is arranged in matrix. Each of the plurality of signal lines 104 is electrically connected to pixels in any column of the plurality of pixels arranged in matrix, and each of the plurality of scan lines 105 is electrically connected to pixels in any row of the plurality of pixels arranged in matrix. Note that a signal such as a data signal (Data), a clock signal (CK), or a start signal (SP), and a power supply for driving such as a high power supply potential ($V_{dd}$), or a low power supply potential ($V_{SS}$) are externally input to the signal line driver circuit 102 and the scan line driver circuit 103.

Figure 1B:
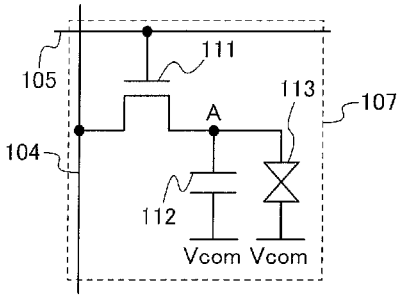

FIG. 1B is an example of a circuit diagram of a pixel 107 included in the display device illustrated in FIG. 1A. The pixel 107 illustrated in FIG. 1B includes a transistor 111 having a gate electrically connected to the scan line 105 and one of a source and a drain electrically connected to the signal line 104; a capacitor 112 having one terminal electrically connected to the other of the source and the drain of the transistor 111, and the other terminal electrically connected to a wiring (also referred to as a common potential line) for supplying a common potential ($V_{com}$); and a liquid crystal element 113 having one terminal electrically connected to the other of the source and the drain of the transistor 111 and one terminal of the capacitor 112, and the other terminal electrically connected to a common potential line. Note that the transistor 111 is an n-channel transistor. Further, a node where the other of the source and the drain of the transistor 111, one of the terminals of the capacitor 112, and one of the terminals of the liquid crystal element 113 are electrically connected is referred to as a node A.

Figure 1C:
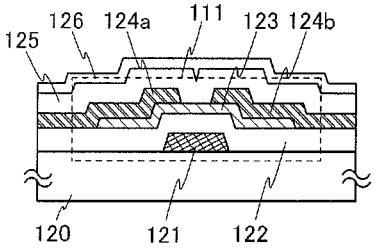

FIG. 1C illustrates a specific structure of the transistor 111 included in the pixel 107 in FIG. 1B. The transistor 111 in FIG. 1C includes a gate layer 121 provided over a substrate 120 having an insulating surface, a gate insulating layer 122 provided over the gate layer 121, an oxide semiconductor layer 123 provided over the gate insulating layer 122, and a source layer 124*a* and a drain layer 1246 provided over the oxide semiconductor layer 123. Further, in the transistor 111 illustrated in FIG. 1C, an insulating layer 125 which covers the transistor 111 and is in contact with the oxide semiconductor layer 123, and a protective insulating layer 126 provided over the insulating layer 125 are formed.

As described above, the transistor 111 in FIG. 1C includes the oxide semiconductor layer 123 as a semiconductor layer. As an oxide semiconductor used for the oxide semiconductor layer 123, an In—Sn—Ga—Zn—O-based oxide semiconductor layer which is an oxide of four metal elements; an In—Ga—Zn—O-based oxide semiconductor layer, an In—Sn—Zn—O-based oxide semiconductor layer, an In—Al—Zn—O-based oxide semiconductor layer, a Sn—Ga—Zn—O-based oxide semiconductor layer, an Al—Ga—Zn—O-based oxide semiconductor layer, or a Sn—Al—Zn—O-based oxide semiconductor layer which are oxides of three metal elements; an In—Zn—O-based oxide semiconductor layer, an In—Ga—O-based oxide semiconductor layer, a Sn—Zn—O-based oxide semiconductor layer, an Al—Zn—O-based oxide semiconductor layer, a Zn—Mg—O-based oxide semiconductor layer, a Sn—Mg—O-based oxide semiconductor layer, or an In—Mg—O-based oxide semiconductor layer which are oxides of two metal elements; or an In—O-based oxide semiconductor layer, a Sn—O-based oxide semiconductor layer, or a Zn—O-based oxide semiconductor layer which are oxides of single metal element can be used. Further, $SiO_2$ may be contained in the above oxide semiconductor. Here, for example, an In—Ga—Zn—O-based oxide semiconductor is an oxide including at least In, Ga, and Zn, and there is no particular limitation on the composition ratio thereof. Further, the In—Ga—Zn—O-based oxide semiconductor may contain an element other than In, Ga, and Zn.

For the oxide semiconductor layer 123, a thin film, represented by the chemical formula, $InMO_3(ZnO)_m$ (m>0) can be used. Here, M represents one or more metal elements selected from Ga, Al, Mn, and Co. For example, M may be Ga, Ga and Al, Ga and Mn, Ga and Co, or the like.

The above-described oxide semiconductor is an oxide semiconductor which is highly purified and is made to be electrically i-type (intrinsic) as follows: an impurity such as hydrogen, moisture, a hydroxy group, or hydride (also referred to as a hydrogen compound), which is a factor of the variation in electric characteristics, is intentionally eliminated. Accordingly, the variation in electric characteristics of the transistor including the oxide semiconductor as a semiconductor layer can be suppressed.

Therefore, it is preferable that the oxide semiconductor contain as little hydrogen as possible. Further, the highly purified oxide semiconductor has very few carriers which are derived from hydrogen, oxygen deficiency, and the like (close to zero) and the carrier density is less than $1\times10^{12}/cm^3$, preferably less than $1\times10^{11}/cm^3$. In other words, the density of carriers derived from hydrogen, oxygen deficiency, and the like in the oxide semiconductor layer is made as close to zero as possible. Since the oxide semiconductor layer has very few carriers derived from hydrogen, oxygen deficiency, and the like, the amount of off-state current can be small. The smaller the amount of off-state current is, the better. The transistor including the oxide semiconductor layer as a semiconductor layer has a current value per micrometer channel width (1 μm) of 100 zA/μm or less, preferably 10 zA/μm or less, more preferably, 1 zA/μm or less. Furthermore, because there is no PN junction and no hot carrier degradation, electrical characteristics of the transistor are not adversely affected thereby.

The oxide semiconductor which is highly purified by drastically removing hydrogen contained in the oxide semiconductor layer as described above is used in a channel formation region of a transistor, whereby the transistor with an extremely small amount of off-state current can be obtained. In other words, the circuit can be designed with the oxide semiconductor layer that can be regarded as an insulator when the transistor is in a non-conducting state. On the other hand, when the transistor is in a conducting state, the current supply capability of the oxide semiconductor layer is expected to be higher than the current supply capability of a semiconductor layer formed of amorphous silicon.

Although there is no particular limitation on a substrate that can be used as the substrate 120 having an insulating surface. For example, a glass substrate made of barium borosilicate glass, aluminoborosilicate glass, or the like can be used.

In the transistor 111, an insulating film serving as a base film may be provided between the substrate 120 and the gate layer 121. The base film has a function of preventing diffusion of an impurity element from the substrate, and can be formed to have a single-layer structure or a stacked structure using one or more of a silicon nitride film, a silicon oxide film, a silicon nitride oxide film, and a silicon oxynitride film.

The gate layer 121 can be formed in a single layer or a stacked layer using a metal material such as molybdenum, titanium, chromium, tantalum, tungsten, aluminum, copper, neodymium, or scandium, or an alloy material which includes any of these materials as a main component.

The gate insulating layer 122 can be formed to have a single layer or a stacked layer including a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, or a hafnium oxide layer by a plasma CVD method, a sputtering method, or the like. For example, by a plasma CVD method, a silicon nitride layer ($SiN_y$ (y>0)) with a thickness of greater than or equal to 50 nm and less than or equal to 200 nm is formed as a first gate insulating layer, and a silicon oxide layer ($SiO_x$ (x>0)) with a thickness of greater than or equal to 5 nm and less than or equal to 300 nm can be formed as a second gate insulating layer over the first gate insulating layer.

A conductive film used for the source layer 124*a* and the drain layer 124*b* can be formed using an element selected from Al, Cr, Cu, Ta, Ti, Mo, and W, an alloy including any of these elements as a component, an alloy film including a combination of any of these elements, or the like. Alternatively, a structure may be employed in which a high-melting-point metal layer of Ti, Mo, W, or the like is stacked over and/or below a metal layer of Al, Cu, or the like. In addition, heat resistance can be improved by using an Al material to which all element (Si, Nd, Sc, or the like) which prevents generation of a hillock or a whisker in an Al film is added.

Alternatively, the conductive film to be the source layer 124*a* and the drain layer 124*b* (including a wiring layer formed using the same layer as the source layer 124*a* and the drain layer 124*b*) may be formed using a conductive metal oxide. As conductive metal oxide, indium oxide ($In_2O_3$), tin oxide ($SnO_2$), zinc oxide (ZnO), indium oxide-tin oxide alloy ($In_2O_3$—$SnO_2$, which is abbreviated to ITO), indium oxide-zinc oxide alloy ($In_2O_3$—ZnO), or any of these metal oxide materials in which silicon oxide is contained can be used.

As the insulating layer 125, typically, an inorganic insulating film such as a silicon oxide film, a silicon oxynitride film, an aluminum oxide film, or an aluminum oxynitride film can be used.

As the protective insulating layer 126, all inorganic insulating film such as a silicon nitride film, an aluminum nitride film, a silicon nitride oxide film, or an alumminum nitride oxide film can be used.

A planarization insulating film may be formed over the protective insulating layer 126 in order to reduce surface roughness caused by a transistor. As the planarization insulating film, an organic material such as polyimide, acrylic, or benzocyclobutene can be used. Other than such organic materials, it is also possible to use a low-dielectric constant material (a low-k material) or the like. Note that the planarization insulating film may be formed by stacking a plurality of insulating films formed from these materials.

(Off-State Current of Transistor)

Next, results obtained by measurement of the off-state current of a transistor including a highly purified oxide semiconductor will be described.

Figure 9:
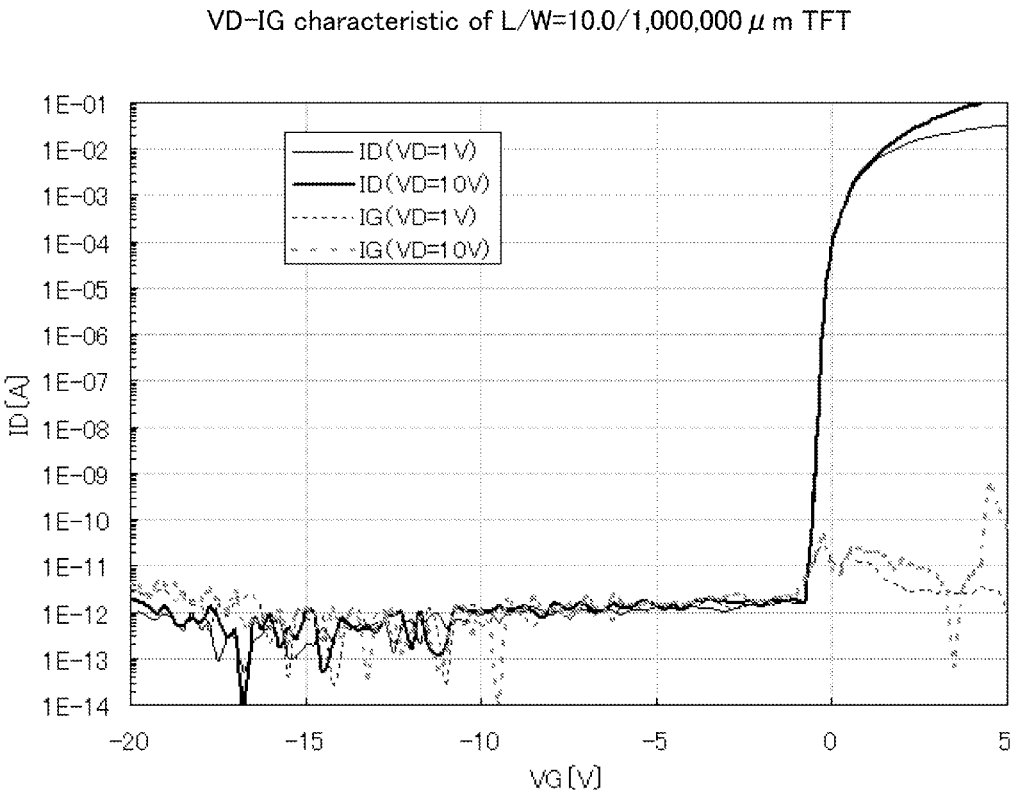
FIG. 9 is a graph showing the characteristics of a transistor.

First, a transistor with a channel width W of 1 m, which was sufficiently large, was prepared in consideration of the fact that off-state current of a transistor including a highly purified oxide semiconductor layer is extremely small, and the off-state current was measured. FIG. 9 shows the results obtained by measurement of the off-state current of a transistor with a channel width W of 1 m. In FIG. 9, the horizontal axis shows gate voltage $V_G$ and the vertical axis shows drain current $I_D$. In the case where the drain voltage $V_D$ is +1 V or +10 V and the gate voltage $V_G$ is within the range of −5 V to −20 V, the off-state current of the transistor was found to be smaller than or equal to $1\times10^{-12}$ A which is the detection limit. Moreover, it was found that the off-state current of the transistor (per unit channel width (1 μm)) is smaller than or equal to 1 aA/μm ($1\times10^{-18}$ A/μm).

Next will be described the results obtained by measurement the off-state current of the transistor including a highly purified oxide semiconductor layer more accurately. As described above, the off-state current of the transistor including a highly purified oxide semiconductor was found to be smaller than or equal to $1\times10^{-12}$ A, which is the detection limit of the measurement equipment. Here, the results obtained by measurement of more accurate off-state current (the value smaller than or equal to the detection limit of measurement equipment in the above measurement), with the use of an element for characteristic evaluation, will be described.

First, the element for characteristic evaluation used in a method for measuring current will be described with reference to FIG. 10.

Figure 10:
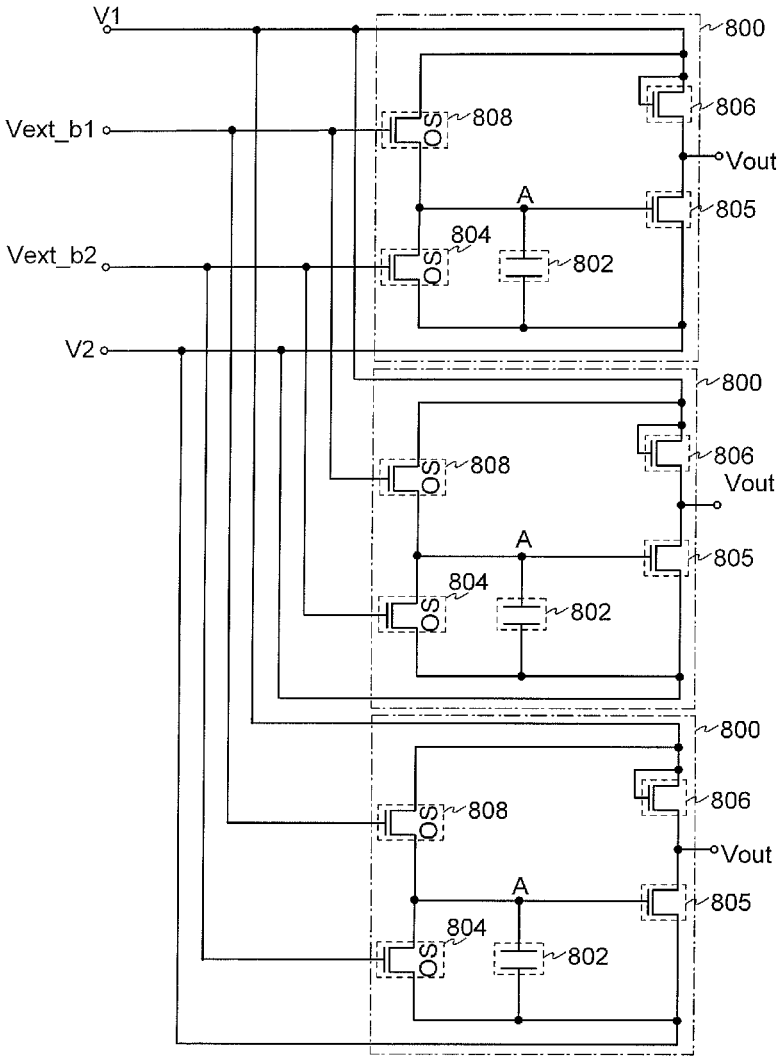
FIG. 10 is a diagram of a circuit for evaluating characteristics of a transistor.

In the element for characteristic evaluation in FIG. 10, three measurement systems 800 are connected in parallel. The measurement system 800 includes a capacitor 802, a transistor 804, a transistor 805, a transistor 806, and a transistor 808. The transistor including a highly purified oxide semiconductor is used as the transistors 804 and 808.

In the measurement system 800, one of a source terminal and a drain terminal of the transistor 804, one of terminals of the capacitor 802, and one of a source terminal and a drain terminal of the transistor 805 are connected to a power source (for supplying V2). The other of the source terminal and the drain terminal of the transistor 804, one of a source terminal and a drain terminal of the transistor 808, the other of the terminals of the capacitor 802, and a gate terminal of the transistor 805 are connected to one another. The other of the source terminal and the drain terminal of the transistor 808, one of a source terminal and a drain terminal of the transistor 806, and a gate terminal of the transistor 806 are connected to a power source (for supplying V1). The other of the source terminal and the drain terminal of the transistor 805 and the other of the source terminal and the drain terminal of the transistor 806 are connected to an output terminal.

A potential $V_{ext_2}$ for controlling an on state and an off state of the transistor 804 is supplied to the gate terminal of the transistor 804. A potential $V_{ext_b1}$ for controlling an on state and an off state of the transistor 808 is supplied to the gate terminal of the transistor 808. A potential $V_{out}$ is output from the output terminal.

Next, a method for measuring current with the use of the element for characteristic evaluation will be described.

First, an initialization period in which a potential difference is applied to measure the off-state current will be described briefly. In the initialization period, the potential $V_{ext_b1}$ for turning on the transistor 808 is input to the gate terminal of the transistor 808, and a potential V1 is supplied to a node A that is a node connected to the other of the source terminal and the drain terminal of the transistor 804 (i.e., the node connected to one of the source terminal and the drain terminal of the transistor 808, the other terminal of the capacitor 802, and the gate terminal of the transistor 805). Here, the potential V1 is, for example, a high potential. The transistor 804 is turned off.

After that, the potential $V_{ext_b1}$ for turning off the transistor 808 is input to the gate terminal of the transistor 808 so that the transistor 808 is turned off. After the transistor 808 is turned off, the potential V1 is set to low. Still, the transistor 804 is off. The potential V2 is the same potential as V1. Thus, the initialization period is completed. In a state where the initialization period is completed, a potential difference is generated between the node A and one of the source terminal and the drain terminal of the transistor 804, and also, a potential difference is generated between the node A and the other of the source terminal and the drain terminal of the transistor 808. Therefore, electric charge flows slightly through the transistor 804 and the transistor 808. That is, the off-state current flows.

Next, a measurement period of the off-state current is briefly described. In the measurement period, the potential (that is, V2) of the one of the source terminal and the drain terminal of the transistor 804 and the potential (that is, V1) of the other of the source terminal and the drain terminal of the transistor 808 are set to low and fixed. On the other hand, the potential of the node A is not fixed (the node A is in a floating state) in the measurement period. Accordingly, electric charge flows through the transistors 804 and 808 and the amount of electric charge held at the node A changes as time goes by. The potential of the node A varies depending on the variation in the amount of electric charge stored in the node A. That is to say, the output potential $V_{out}$ of the output terminal also varies.

Figure 11:
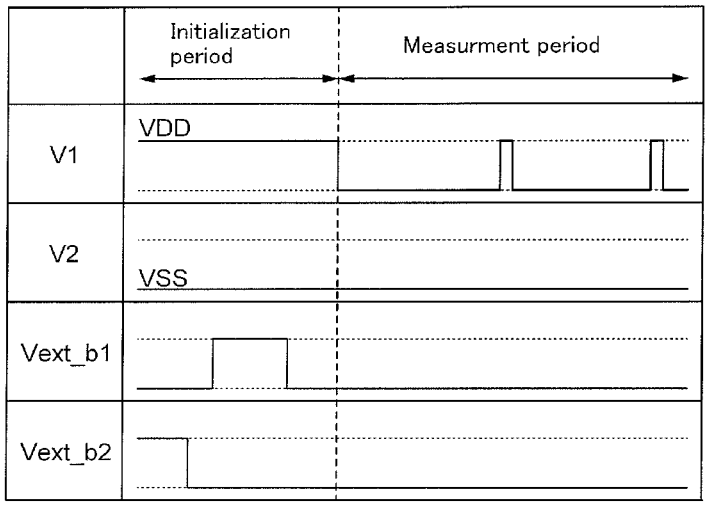
FIG. 11 is a timing diagram for evaluating the characteristics of a transistor.

FIG. 11 shows details of the relation (timing chart) between potentials in the initialization period in which the potential difference is applied and in the following measurement period.

In the initialization period, first, the potential $V_{ext_b2}$ is set to a potential (high potential) at which the transistor 804 is turned on. Thus, the potential of the node A comes to be V2, that is, a low potential ($V_{SS}$). Note that a low potential ($V_{SS}$) is not necessarily supplied to the node A. After that, the potential $V_{ext_b2}$ is set to a potential (low potential) at which the transistor 804 is turned off, whereby the transistor 804 is turned off. Next, the potential $V_{ext_b1}$ is set to a potential (a high potential) at which the transistor 808 is turned on. Thus, the potential of the node A comes to be V1, that is, a high potential ($V_{DD}$). After that, the potential $V_{ext_b1}$ is set to a potential at which the transistor 808 is turned off. Accordingly, the node A is brought into a floating state and the initialization period is completed.

In the following measurement period, the potential V1 and the potential V2 are individually set to potentials at which electric charge flows to or from the node A. Here, the potential V1 and the potential V2 are low potentials ($V_{SS}$). Note that at the timing of measuring the output potential $V_{out}$, it is necessary to operate an output circuit; thus, V1 is set to a high potential ($V_{DD}$) temporarily in some cases. The period in which V1 is a high potential ($V_{DD}$) is set to be short so that the measurement is not influenced.

When the potential difference is generated and the measurement period is started as described above, the amount of electric charge stored in the node A varies as time goes by, which varies the potential of the node A. This means that the potential of the gate terminal of the transistor 805 varies and thus, the output potential $V_{out}$ of the output terminal also changes as time goes by.

A method for calculating the off-state current on the basis of the obtained output potential $V_{out}$ is described below.

The relation between the potential $V_A$ of the node A and the output potential $V_{out}$ is obtained in advance before the off-state current is calculated. With this, the potential $V_A$ of the node A can be obtained using the output potential $V_{out}$. In accordance with the above relation, the potential $V_A$ of the node A can be expressed as a function of the output potential $V_{out}$ by the following equation.

$$V_A = F(V\text{out}) \quad \text{[FORMULA 1]}$$

Electric charge $Q_A$ of the node A can be expressed by the following equation with the use of the potential $V_A$ of the node A, capacitance $C_A$ connected to the node A, and a constant (const). Here, the capacitance $C_A$ connected to the node A is the sum of the capacitance of the capacitor 802 and other capacitance.

$$Q_A = C_A V_A + \text{const} \quad \text{[FORMULA 2]}$$

Since a current $I_A$ of the node A is obtained by differentiating electric charge flowing to the node A (or electric charge flowing from the node A) with respect to time, the current $I_A$ of the node A is expressed by the following equation.

$$I_A \equiv \frac{\Delta Q_A}{\Delta t} = \frac{C_A \cdot \Delta F(Vout)}{\Delta t} \quad \text{[FORMULA 3]}$$

In this manner, the current $I_A$ of the node A can be obtained from the capacitance $C_A$ connected to the node A and the output potential $V_{out}$ of the output terminal.

In accordance with the above method, it is possible to measure off-state current which flows between a source and a drain of a transistor in an off state.

Here, the transistor 804 and the transistor 808 were formed using a highly purified oxide semiconductor with a channel length L of 10 μm and a channel width W of 50 μm. In addition, in the measurement systems 800 which are arranged in parallel, values of the capacitance of the capacitors 802 were 100 fF, 1 pF, and 3 pF, respectively.

Note that in the measurement of this example, $V_{DD}$ was 5 V and $V_{SS}$ was 0 V. In the measurement period, the potential V1 was basically set to $V_{SS}$ and set to $V_{DD}$ only in a period of 100 msec every 10 to 300 seconds, and $V_{out}$, was measured. Further, Δt which was used in calculation of current I which flows through the element was about 30000 sec.

Figure 12:
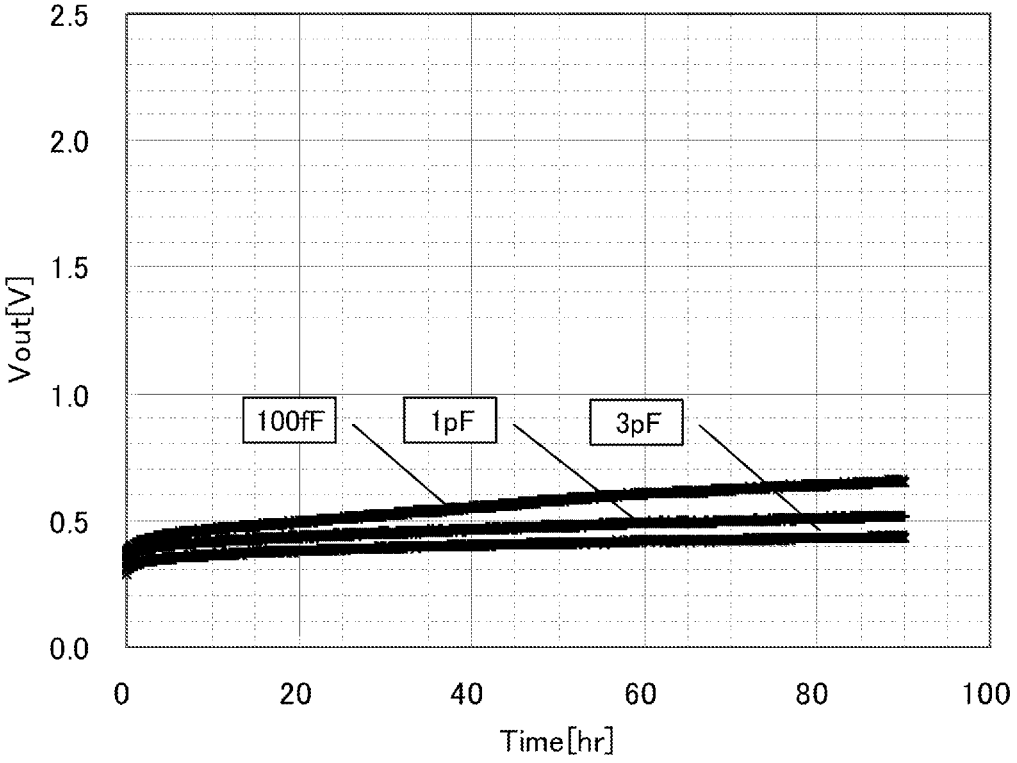
FIG. 12 is a graph showing the characteristics of a transistor.

FIG. 12 shows the relation between elapsed time Time in measuring the current and the output potential $V_{out}$. According to FIG. 12, the potential changes as time goes by.

Figure 13:
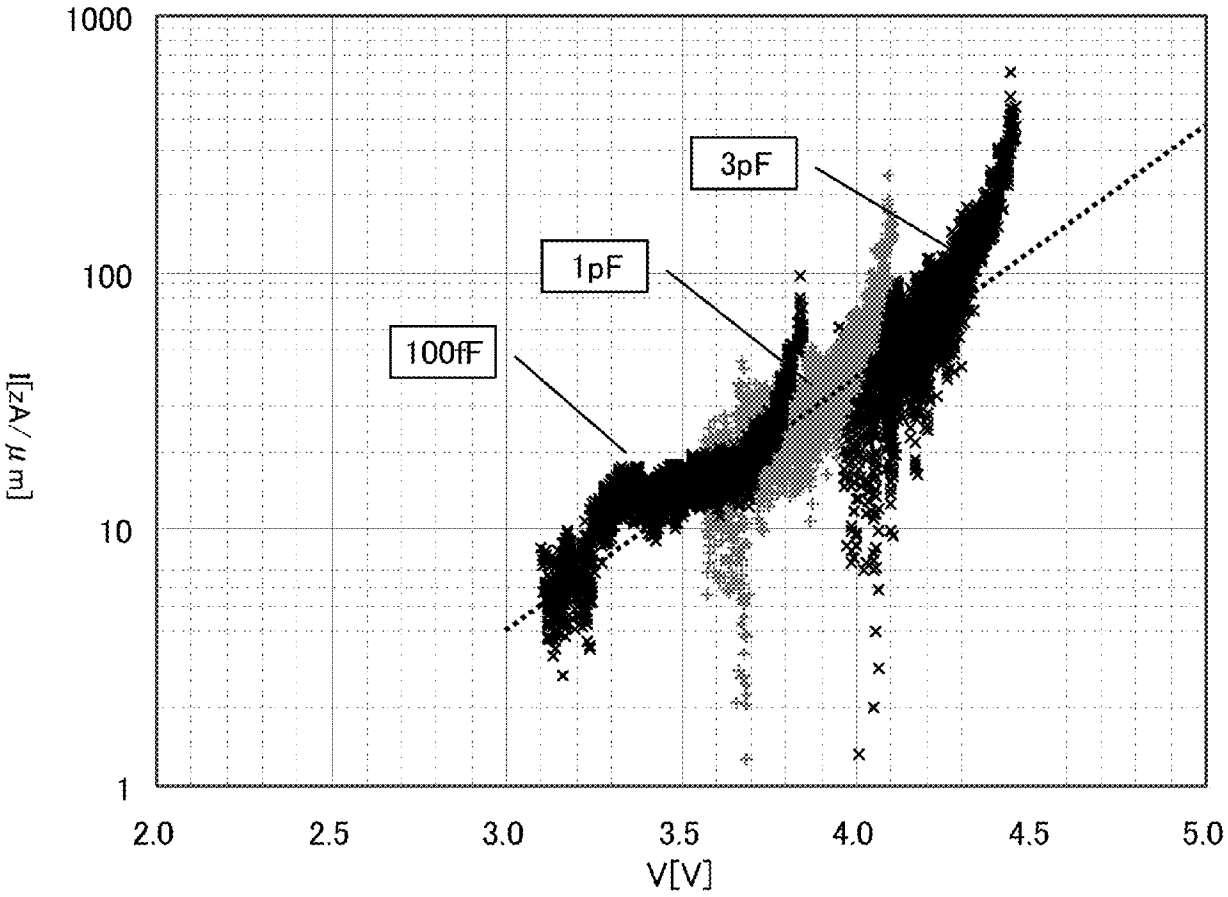
FIG. 13 is a graph showing the characteristics of a transistor.

FIG. 13 shows the off-state current at room temperature (25° C.) calculated based on the above current measurement. Note that FIG. 13 shows the relation between a source-drain voltage V of the transistor 804 or the transistor 808 and off-state current I. According to FIG. 13, the off-state current was about 40 zA/μm under the condition that the source-drain voltage was 4 V. In addition, the off-state current was less than or equal to 10 zA/μm under the condition where the source-drain voltage was 3.1 V. Note that 1 zA represents $10^{-21}$ A.

Figure 14:
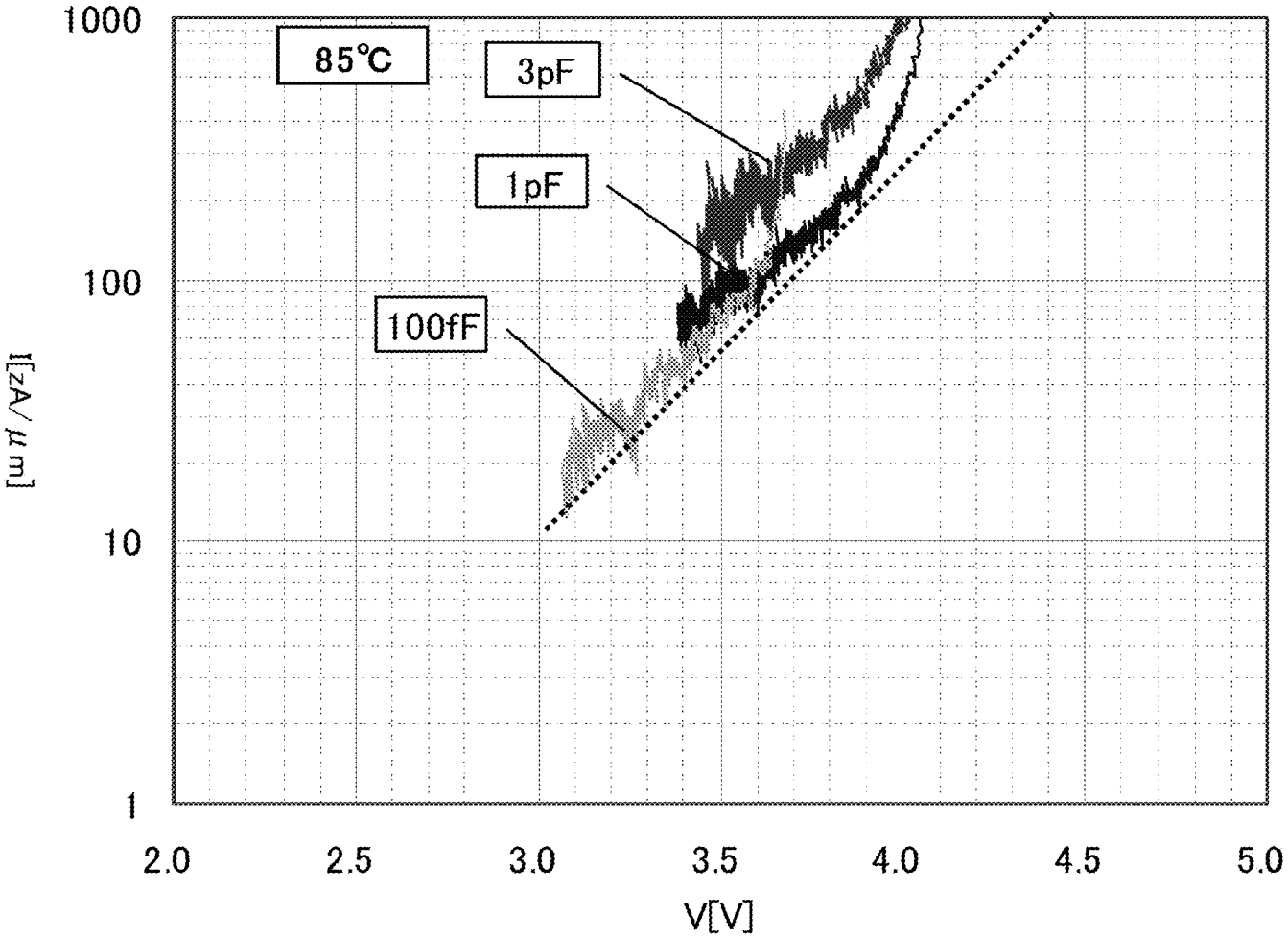
FIG. 14 is a graph showing the characteristics of a transistor.

Further, FIG. 14 shows the off-state current in an environment at a temperature of 85° C., which was calculated based on the above current measurement. FIG. 14 shows the relation between a source-drain voltage V and an off-state current I in a circumstance at 85° C. According to FIG. 14, the off-state current was less than or equal to 100 zA/μm under the condition where the source-drain voltage was 3.1 V.

According to this example, it was confirmed that the off-state current can be sufficiently small in a transistor including a highly purified oxide semiconductor layer.

(Example of Operation of Active Matrix Display Device)

Figure 2:
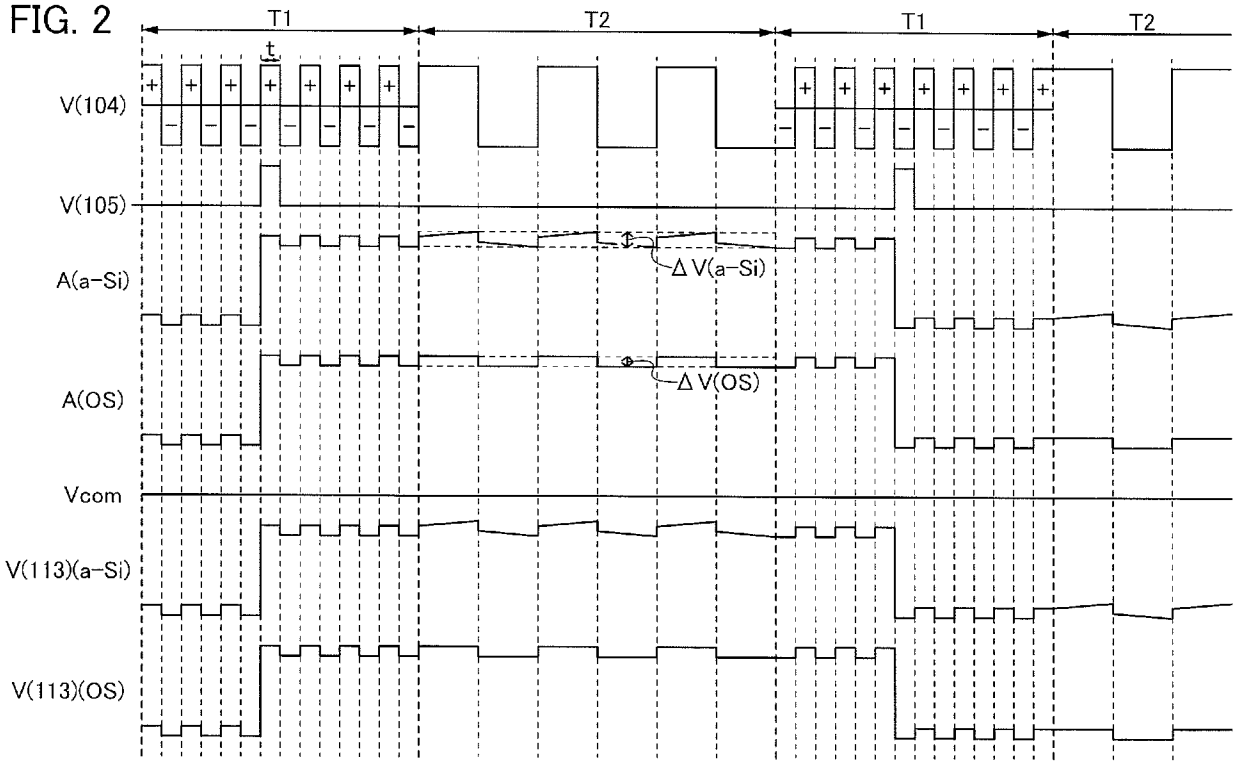
FIG. 2 illustrates an operation of a display device.

Next, an example of the operation of the aforementioned display device will be described with reference to FIG. 2. Note that FIG. 2 schematically illustrates the potential of the signal line 104 (V (104)), the potential of the scan line 105 (V (105)), the potential of the node A (A(OS)) in the case where the transistor 111 includes an oxide semiconductor layer, the common potential ($V_{com}$), and a voltage (V (113)(OS)) applied to the liquid crystal element 113 in the case where the transistor 111 includes an oxide semiconductor layer, which are illustrated in FIG. 1B. In addition, FIG. 2 schematically illustrates the potential of the node A in the case where the transistor 111 is a transistor including an amorphous silicon layer (A (a-Si)), and a voltage (V (113) (a-Si)) applied to the liquid crystal element 113 in the case where the transistor III is a transistor including an amorphous silicon layer for comparison.

A data signal is supplied to the signal line 104 in a scanning period (T1), and an alternating-current driving signal is supplied in a break period (T2). Note that the data signal is a signal whose polarity is inverted every horizontal scanning period (t: one gate selection period). That is, the display device disclosed in this specification is a display device which performs gate line inversion drive. Note that the data signal is an analog signal. Further, the driving signal is an alternating-current signal whose polarity is inverted every period that is longer than at least one horizontal scanning period. Note that the driving signal is a binary signal. Further, variation in voltage of the driving signal can be within the voltage variation range of the data signal.

A high-level potential (selection signal) is supplied to the scan line 105 in one specific horizontal scanning period included in the scanning period (T1), and a low-level potential (non-selection signal) is supplied to the scan line 105 in periods other than the period T1. That is, the transistor 111 included in the pixel 107 is turned on in the one specific horizontal scanning period, and is turned off in the other periods.

In the node A, a data signal is supplied from the signal line 104 through the transistor 111 in the one horizontal scanning period, and the signal is not supplied in the other periods. That is, in the periods other than the one horizontal scanning period, the node A is in a floating state. Therefore, in the periods other than the one horizontal scanning period, the potential of the node A is varied by capacitive coupling between the signal line 104 and the node A. Note that the variation in the potential of the node A caused by the capacitive coupling does not significantly depend on whether the transistor 111 is a transistor including an amorphous silicon layer or a transistor including an oxide semiconductor layer.

However, the amount of variation in the potential of the node A in the break period differs depending on whether the transistor 111 is a transistor including amorphous silicon or a transistor including an oxide semiconductor. Specifically, the amount of variation in the potential of the node A in the break period (T2) is smaller in the transistor including an oxide semiconductor layer than the transistor including amorphous silicon layer (ΔV (a-Si)>ΔV (OS)). This is because the transistor including an oxide semiconductor layer has small off-state current than the transistor including an amorphous silicon layer.

Note that fixed potential is applied to the common potential ($V_{com}$) here. A ground potential, 0 V, or the like can be applied to the fixed potential.

Voltage corresponding to a potential difference between the potential of the node A and the common potential ($V_{com}$)

is applied to the liquid crystal element 113. Thus, a change in voltage applied to the liquid crystal element 113 is the same as that in the potential of the node A.

The display in the pixel 107 is determined by the voltage applied to the liquid crystal element 113. In the above-described display device, the voltage is varied by capacitive coupling between the signal line 104 and the node A and off-state current generated in the transistor 111. Therefore, to be exact, the actual display in the pixel 107 differs from display formed based on the data signal input to the pixel 107 in one horizontal scanning period. A specific example is described below. For example, in the scanning period, a data signal is input 60 times per second (once in approximately 16.7 ms) to the pixel 107. In that case, one horizontal scanning period is several orders of magnitude shorter than 16.7 ms. Here, the one horizontal scanning period is 16.7 μs for convenience (for example, in the case where the number of rows of a plurality of pixels arranged in matrix is 1,000, the one horizontal scanning period is approximately 16.7 μs.). At that time, a data signal is supplied to pixels provided for the same row as the pixel 107 in the periods other than the one horizontal scanning period, thus, the potential of the signal line 104 varies in the periods other than the one horizontal scanning period. Thus, to be exact, the potential of the node A is varied by capacitive coupling between the signal line 104 and the node A, and the substantial display of the pixel 107 for 16.7 ms differs from the display based on the data signal supplied from the signal line 104 in the one horizontal scanning period (16.7 μs).

Further, the display device disclosed in this specification has a break period. For example, in the case where the potential of the signal line 104 is at a fixed potential or in a floating state in the break period, capacitive coupling does not affect variation in voltage applied to the liquid crystal element 113. In that case the display of the pixel 107 in the scanning period differs from the display of the pixel 107 in the break period. On the contrary, in the display device disclosed in this specification, an alternating-current driving signal is supplied to the signal line 104 in the break period. Thus, the variation in voltage applied to the liquid crystal element 113 is affected by the capacitive coupling that is the same degree as that in the scanning period. Therefore, the display of the pixel 107 in the break period can be the same as that in the scanning period.

Further, in the display device disclosed in this specification, a transistor including an oxide semiconductor layer is used as the transistor 111 provided for the pixel 107. Thus, the off-state current of the transistor 111, which affects the voltage applied to the liquid crystal element 113, can be reduced. Accordingly, a signal holding period of the pixel 107 can be extended. That is, the break period can be extended. In addition, in the break period, amplitude of voltage applied to the liquid crystal element 113 can be reduced. Therefore, generation of flickers in display of the pixel 107 can be reduced. In particular, this effect is significant in the case where the frequency of the alternating-current driving signal is reduced.

As described above, the display device disclosed in this specification is a display device which can hold display quality by using the transistor including an oxide semiconductor as the transistor 111 even in the case where the break period is lengthened or in the case where the frequency of the alternating-current driving signal supplied to the signal line 104 is reduced in the break period. That is, the display device disclosed in this specification is a display device whose power consumption can be reduced and deterioration of display quality can be suppressed.

(Modified Example of Active Matrix Display Device)

The above described display device is an embodiment of the present invention, and a display device different from the above display device in some points is included in the present invention.

Figure 3:
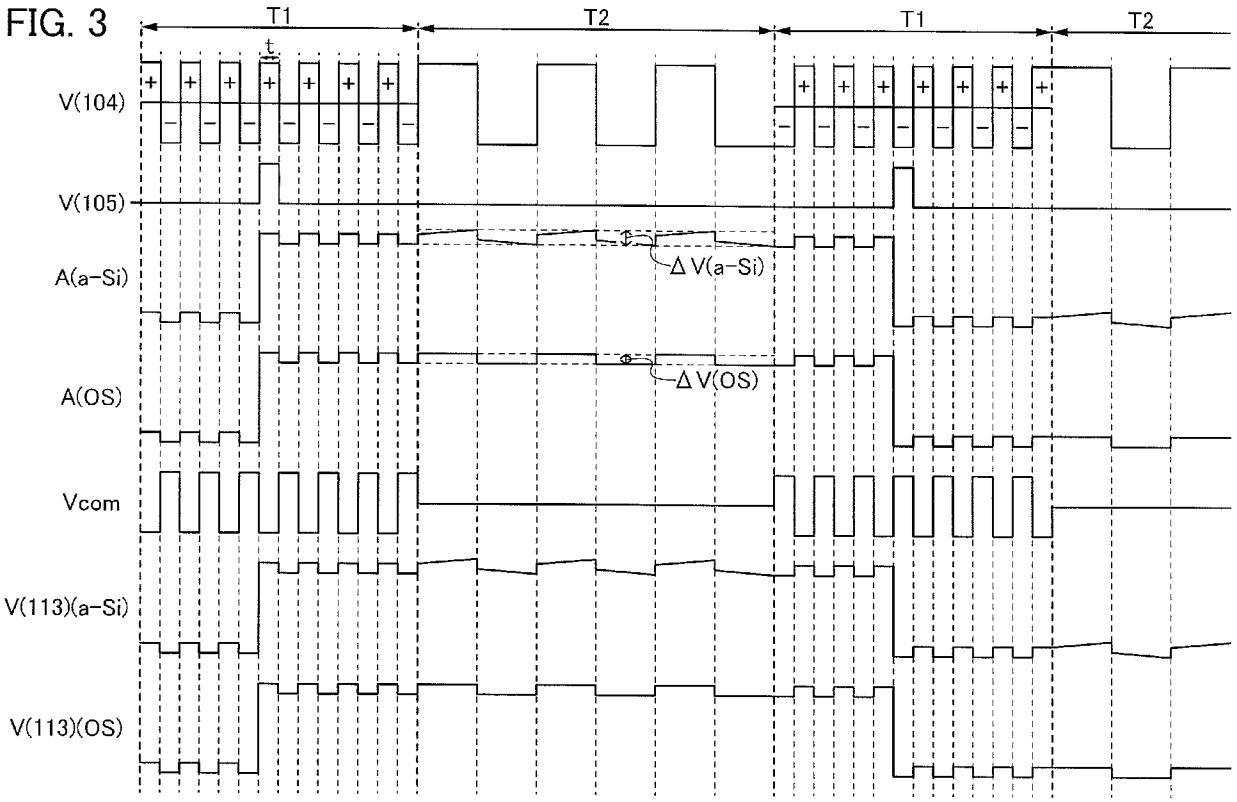
FIG. 3 illustrates an operation of a display device.

For example, the above-described display device has a structure in which a fixed potential is supplied to the common potential line; however, the display device may have a structure in which an alternating-current driving signal (a first driving signal for the common potential line) is supplied to the common potential line (what is called common inversion driving) (see FIG. 3). Accordingly, voltage amplitude of the data signal can be reduced by half. In that case, the potential of the common potential line becomes a binary signal having an opposite polarity to the data signal in the scanning period, and becomes a fixed potential in the break period.

Figure 4:
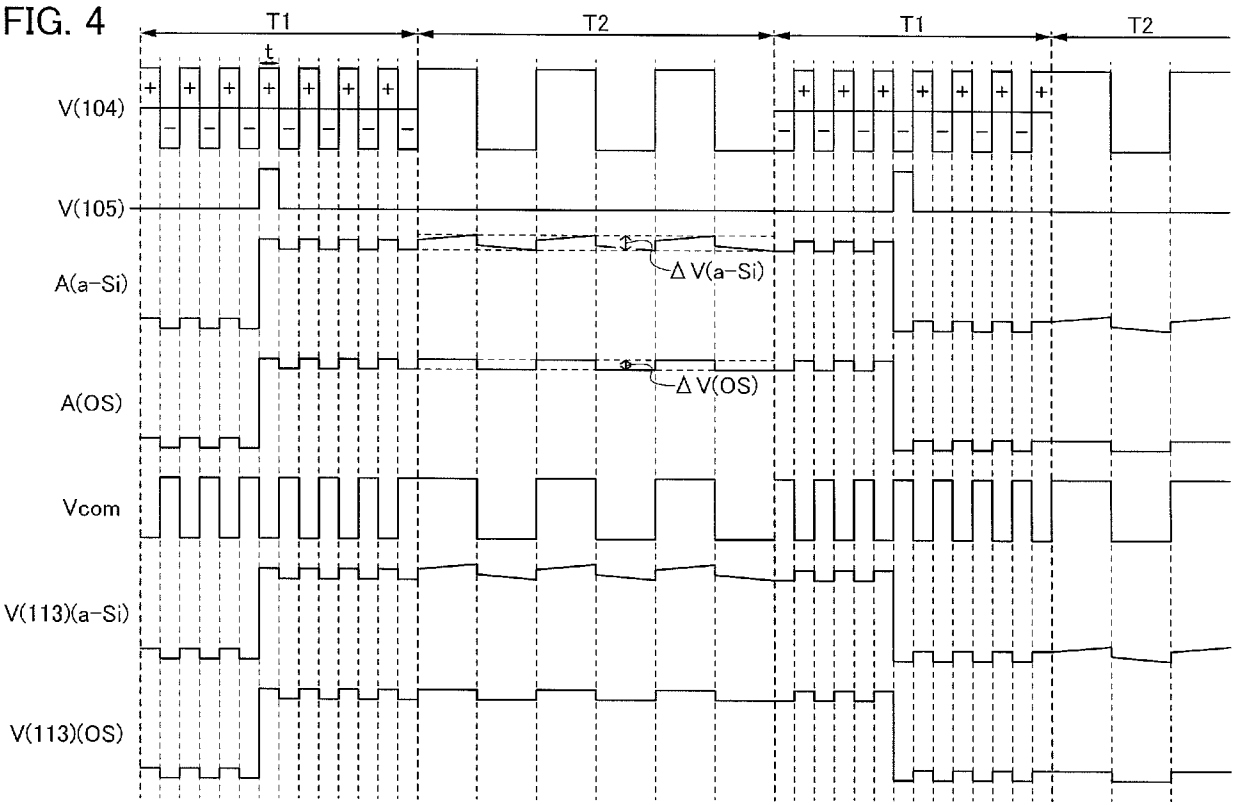
FIG. 4 illustrates an operation of a display device.

Furthermore, in the break period, an alternating-current driving signal (a second driving signal for the common potential line) may be supplied to the common potential line (see FIG. 4). In that case, the potential of the common potential line becomes a binary signal (the first driving signal for the common potential line) having an opposite polarity to the data signal in the scanning period, and becomes a binary signal (the second driving signal for the common potential line) having the same polarity as the alternating-current driving signal supplied to the signal line 104 in the break period. Note that in the break period, the variation in the voltage of the alternating-current driving signal (the second driving signal for the common potential line) supplied to the common potential line can be within the voltage variation range of the alternating-current driving signal (the first driving signal for the common potential line) supplied to the common potential line. Furthermore, in the break period, the alternating-current driving signal supplied to the common potential line (the second driving signal for the common potential line) can be the same signal as the alternating-current driving signal supplied to the signal line 104 in the break period.

In the above described display device, the structure in which an alternating-current driving signal which is supplied to the signal line 104 is a binary signal in the break period is illustrated; however, a structure may be employed in which the driving signal may includes a multivalued signal.

Further, in the above display device, the structure is illustrated in which the other terminal of the capacitor 112 and the other terminal of the liquid crystal element 113 are each electrically connected to a wiring to which the same common potential ($V_{com}$) is supplied; however, a structure may be employed in which the common potential supplied to each of the wirings electrically connected to the other terminal of the capacitor 112 and the other terminal of the liquid crystal element 113 may be different. That is, a structure may be employed in which the other terminal of the capacitor 112 is electrically connected a wiring to which the first common potential is supplied, and the other terminal of the liquid crystal element 113 is electrically connected to a wiring to which the second common potential that is different from the first common potential is supplied.

Further, in the above-described display device, as the transistor 111, one of bottom-gate structures, which is called a channel etched type is illustrated (see FIG. 1C); however, the structure of the transistor 111 is not limited thereto. For example, the transistor illustrated in FIGS. 5A to 5C can be used.

Figure 5A:
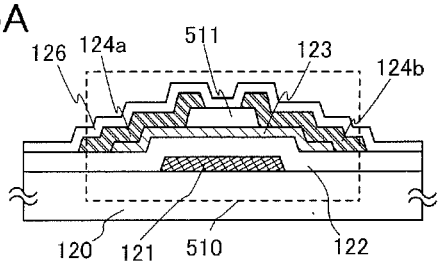
FIGS. 5A to 5C each illustrate an example of a transistor provided for a pixel of a display device.

A transistor 510 illustrated in FIG. 5A is a kind of bottom-gate structure referred to as a channel-protective type (channel-stop type).

The transistor 510 includes, over the substrate 120 having an insulating surface, the gate layer 121, the gate insulating layer 122, the oxide semiconductor layer 123, an insulating layer 511 functioning as a channel protective layer which covers a channel formation region of the oxide semiconductor layer 123, the source layer 124*a*, and the drain layer 124*b*. Further, the protective insulating layer 126 is formed so as to cover the source layer 124*a*, the drain layer 124*b*, and the insulating layer 511.

Figure 5B:
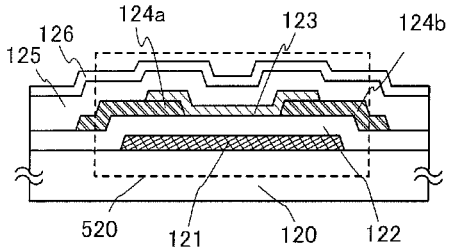

A transistor 520 illustrated in FIG. 5B is a bottom-gate transistor. The transistor 520 includes, over the substrate 120 having an insulating surface, the gate layer 121, the gate insulating layer 122, the source layer 124*a*, the drain layer 124*b*, and the oxide semiconductor layer 123. Further, the insulating layer 125 which covers the source layer 124*a* and the drain layer 124*b* and which is in contact with the oxide semiconductor layer 123 is provided. The protective insulating layer 126 is further formed over the insulating layer 125.

In the transistor 520, the gate insulating layer 122 is provided on and in contact with the substrate 120 and the gate layer 121, and the source layer 124*a* and the drain layer 124*b* are provided on and in contact with the gate insulating layer 122. In addition the oxide semiconductor layer 123 is provided over the gate insulating layer 122 and the source layer 124*a* and drain layer 124*b*.

Figure 5C:
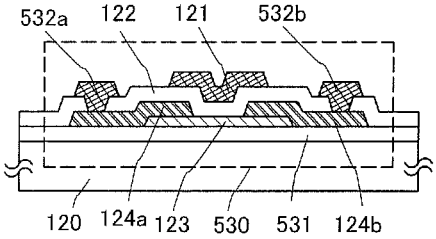

The transistor 530 illustrated in FIG. 5C is one of top-gate transistors. The transistor 530 includes, over the substrate 120 having all insulating surface, an insulating layer 531, the oxide semiconductor layer 123, the source layer 124*a*, the drain layer 124*b*, the gate insulating layer 122, and the gate layer 121. A wiring layer 532*a* and a wiring layer 532*b* are provided to be in contact with and electrically connected to the source layer 124*a* and the drain layer 124*b*, respectively.

As the insulating layers 511 and 531, typically, an inorganic insulating film such as a silicon oxide film, a silicon oxynitride film, an aluminum oxide film, or an aluminum oxynitride film can be used. As a conductive film used for the wiring layer 532*a* and the wiring layer 532*b*, an element selected from Al, Cr, Cu, Ta, Ti, Mo, and W, an alloy film including any of these elements as a component, all alloy film including a combination of any of these elements, or the like can be used. Alternatively, a structure may be employed in which a high-melting-point metal layer of Ti, Mo, W, or the like is stacked over and/or below a metal layer of Al, Cu, or the like. In addition, heat resistance can be improved by using an Al material to which an element (Si, Nd, Sc, or the like) which prevents generation of a hillock or a whisker in an Al film is added.

(Specific Example of Signal Supplied to Active Matrix Display Device)

A specific example of a structure in which a data signal is supplied to a signal line in a scanning period, and an alternating-current driving signal is supplied in a break period is described with reference to FIG. 6.

Figure 6:
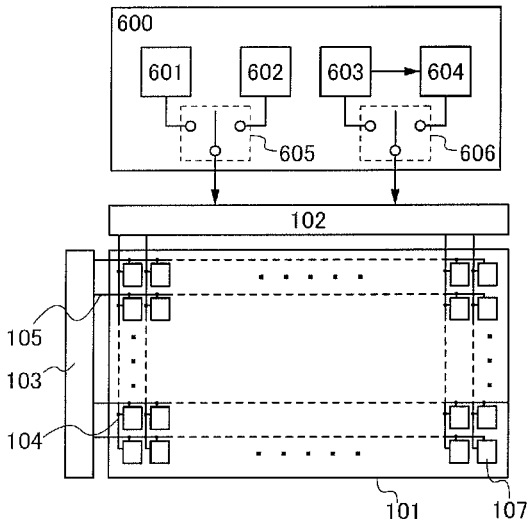
FIG. 6 illustrates a structure of the display device.

The display device illustrated in FIG. 6 includes a controller 600. The controller 600 includes a data signal generation circuit 601 which generates a data signal, a driving signal generation circuit 602 which generates an alternating-current driving signal, a reference clock signal generation circuit 603 which generates a clock signal used in the signal line driver circuit 102 in the scanning period, and a frequency dividing circuit 604 which outputs a signal generated by dividing a clock signal input from the reference clock signal generation circuit 603. Note that the output signal of the frequency dividing circuit 604 becomes a clock signal used in the signal line driver circuit 102 in the break period. The data signal and the clock signal are controlled so that the frequencies thereof are substantially equal to each other. Similarly, the driving signal and the divided signal are controlled so that the frequencies thereof are substantially equal to each other.

Further, the display device illustrated in FIG. 6 includes a switch 605 which selects an output signal of either the data signal generation circuit 601 or the driving signal generation circuit 602 to be output to the signal line driver circuit 102 and a switch 606 which selects an output signal of either the reference clock signal generation circuit 603 or the frequency dividing circuit 604 to be output to the signal line driver circuit 102. Specifically, the switch 605 selects an output signal (data signal) of the data signal generation circuit 601 in the scanning period, and selects an output signal (driving signal) of the driving signal generation circuit 602 in the break period. Further, the switch 606 selects an output signal of the reference clock signal generation circuit 603 in the scanning period and selects an output signal of the frequency dividing circuit 604 in the break period.

The above-described display device can be operated by providing the controller 600 having such a structure and operation.

(Specific Example of Method for Manufacturing Transistor)

A specific example of a transistor which can be used as the transistor 111 is described with reference to FIGS. 7A to 7D.

Figure 7A:
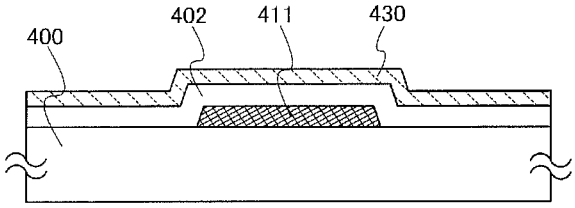
FIGS. 7A to 7D illustrates a transistor.
Figure 7B:
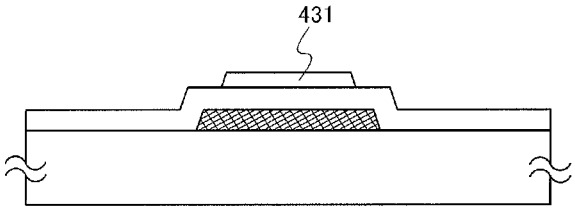
Figure 7C:
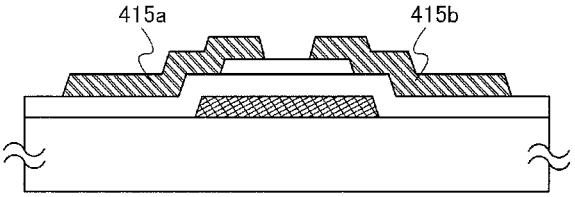
Figure 7D:
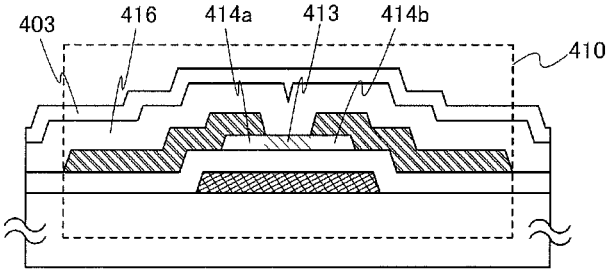

FIGS. 7A to 7D illustrate examples of a specific structure and a process for manufacturing the transistor 111. A transistor 410 illustrated in FIG. 7D has a bottom-gate structure called a channel-etched type. Although a single-gate transistor is illustrated in FIG. 7D, a multi-gate transistor including a plurality of channel formation regions can be formed as needed.

A process for manufacturing the transistor 410 over a substrate 400 is described below with reference to FIGS. 7A to 7D.

First, a conductive film is formed over the substrate 400 having an insulating surface, and a first photolithography step is performed thereon, so that the gate layer 411 is formed. Note that a resist mask used in the process may be formed by an inkjet method. In the case of forming a resist mask by an inkjet method, the manufacturing cost can be reduced because a photomask is not used.

Although there is no particular limitation on a substrate which can be used as the substrate 400 having an insulating surface, it is necessary that the substrate have at least enough heat resistance to a heat treatment to be performed later. For example, a glass substrate made of barium borosilicate glass, aluminoborosilicate glass, or the like can be used. In the case where a glass substrate is used and the temperature at which the heat treatment is to be performed later is high, a glass substrate whose strain point is greater than or equal to 730° C. is preferably used.

Further, an insulating layer serving as a base layer may be provided between the substrate 400 and the gate layer 411. The base layer has a function of preventing diffusion of an impurity element from the substrate 400, and can be formed with a single-layer structure or a stacked structure using one or more of a silicon nitride film, a silicon oxide film, a silicon nitride oxide film, and a silicon oxynitride film.

The gate electrode layer 411 can be formed to have a single-layer structure or a stacked structure using a metal material such as molybdenum, titanium, chromium, tantalum, tungsten, aluminum, copper, neodymium, or scandium or an alloy material which contains any of these materials as its main component.

As a two-layer structure of the gate layer 411, for example, the following structure is preferable: a structure in which a molybdenum layer is stacked over an aluminum layer, a structure in which a molybdenum layer is stacked over a copper layer, a structure in which a titanium nitride layer or a tantalum nitride layer is stacked over a copper layer, or a structure in which a titanium nitride layer and a molybdenum layer are stacked. As a three-layer structure, a three-layer structure of a tungsten layer or a tungsten nitride layer, a layer of an alloy of aluminum and silicon or an alloy of aluminum and titanium, and a titanium nitride layer or a titanium layer is preferable.

Then, a gate insulating layer 402 is formed over the gate layer 411.

The gate insulating layer 402 can be formed to have a single-layer or stacked-layer structure using one or more of a silicon oxide layer, a silicon nitride layer, a silicon oxynitride layer, a silicon nitride oxide layer, and an aluminum oxide layer by a plasma CVD method, a sputtering method, or the like. For example, a silicon oxynitride layer may be formed using a deposition gas containing silane ($SiH_4$), oxygen, and nitrogen by a plasma CVD method. Furthermore, a high-k material such as hafnium oxide ($HfO_x$) or tantalum oxide ($TaO_x$) can be used as the gate insulating layer 402. The gate insulating layer 402 is formed to a thickness of 100 nm to 500 nm inclusive; in the case where the gate insulating layer 402 is formed with a stacked structure, for example, a first gate insulating layer with a thickness of 50 nm to 200 nm inclusive and a second gate insulating layer with a thickness of 5 nm to 300 nm inclusive are stacked.

Here, a silicon oxynitride layer is formed as the gate insulating layer 402 to a thickness of 100 nm or less by a plasma CVD method.

Moreover, as the gate insulating layer 402, a silicon oxynitride layer may be formed with a high density plasma apparatus. Here, the high-density plasma apparatus refers to an apparatus which can realize a plasma density higher than or equal to $1\times10^{11}/cm^3$. For example, plasma is generated by application of a microwave power of 3 to 6 kW so that an insulating layer is formed.

A silane gas ($SiH_4$), nitrous oxide ($N_2O$), and a rare gas are introduced into a chamber as a source gas to generate high-density plasma at a pressure of 10 Pa to 30 Pa, and the insulating layer is formed over the substrate having an insulating surface, such as a glass substrate. After that, the supply of silane ($SiH_4$) is stopped, and a plasma treatment may be performed on a surface of the insulating layer by introducing nitrous oxide ($N_2O$) and a rare gas without exposure to the air. The plasma treatment performed on the surface of the insulating layer by introducing at least nitrous oxide ($N_2O$) and a rare gas is performed after the insulating layer is formed. The insulating layer formed through the above process procedure has a small thickness and is an insulating layer whose reliability can be ensured even though it has a thickness less than 100 nm, for example.

In forming the gate insulating layer 402, the flow ratio of silane ($SiH_4$) to nitrous oxide ($N_2O$) which are introduced into the chamber is in the range of 1:10 to 1:200. In addition, as a rare gas which is introduced into the chamber, helium, argon, krypton, xenon, or the like can be used. In particular, argon, which is inexpensive, is preferably used.

In addition, since the insulating layer formed using the high-density plasma apparatus can have a uniform thickness, the insulating layer has excellent step coverage. Further, with the high-density plasma apparatus, the thickness of a thin insulating film can be controlled precisely.

The insulating layer formed through the above process procedure is greatly different from the insulating layer formed using a conventional parallel plate plasma CVD apparatus. The etching rate of the insulating film formed through the above process procedure is lower than that of the insulating film formed using the conventional parallel plate plasma CVD apparatus by 10% or more or 20% or more in the case where the etching rates with the same etchant are compared to each other. Thus, it can be said that the insulating layer formed using the high-density plasma apparatus is a dense film.

The oxide semiconductor which becomes i-type or becomes substantially i-type (an oxide semiconductor which is highly purified) in a later step is extremely sensitive to an interface state or an interface electric charge; therefore, an interface with the gate insulating layer is important. For that reason, the gate insulating layer that is to be in contact with a highly-purified oxide semiconductor needs to have high quality. Therefore, a high-density plasma CVD apparatus with use of microwaves (2.45 GHz) is preferably employed since a dense and high-quality insulating film having high withstand voltage can be formed. When the highly-purified oxide semiconductor and the high-quality gate insulating layer are in close contact with each other, the interface state density can be reduced and favorable interface characteristics can be obtained. It is important that the gate insulating layer have lower interface state density with an oxide semiconductor and a favorable interface as well as having favorable film quality as a gate insulating layer.

Then, an oxide semiconductor film 430 is formed to a thickness of 2 nm to 200 nm inclusive over the gate insulating layer 402. Note that before the oxide semiconductor film 430 is formed by sputtering, powdery substances (also referred to as particles or dust) which are attached on a surface of the gate insulating layer 402 are preferably removed by reverse sputtering in which an argon gas is introduced and plasma is generated. The reverse sputtering refers to a method in which an RF power source is used for application of a voltage to the substrate side in an argon atmosphere so that plasma is generated in the vicinity of the substrate to modify a surface of the substrate. Note that instead of an argon atmosphere, a nitrogen atmosphere, a helium atmosphere, an oxygen atmosphere, or the like may be used.

As the oxide semiconductor film 430, an In—Ga—Zn—O-based oxide semiconductor film, an In—Sn—O-based oxide semiconductor film, an In—Sn—Zn—O-based oxide semiconductor film, an In—Al—Zn—O-based oxide semiconductor film, a Sn—Ga—Zn—O-based oxide semiconductor film, an Al—Ga—Zn—O-based oxide semiconductor film, a Sn—Al—Zn—O-based oxide semiconductor film, an In—Zn—O-based oxide semiconductor film, an In—Ga—O-based oxide semiconductor film, a Sn—Zn—O-based oxide semiconductor film, an Al—Zn—O-based oxide semiconductor film, an In—O-based oxide semiconductor film, a Sn—O-based oxide semiconductor film, or a Zn—O-based oxide semiconductor film is used. In this embodiment, the oxide semiconductor film 430 is formed by a sputtering method with the use of an In—Ga—Zn—O-based metal oxide target. A cross-sectional view at this stage is illustrated in FIG. 7A. Alternatively, the oxide semiconductor film 430 can be formed by sputtering method in a rare gas (typically argon) atmosphere, an oxygen atmosphere, or a mixed atmosphere of a rare gas (typically argon) and oxygen. When a sputtering method is employed, it is preferable that deposition be performed using a target containing $SiO_2$ of 2 to 10 percent by weight and SiOx (x>0) which inhibits crystallization be contained in the oxide semiconductor film 430 so as to prevent crystallization at the time of the heat treatment for dehydration or dehydrogenation in a later step.

Here, film deposition is performed using a metal oxide target containing In, Ga, and Zn ($In_2O_3$:$Ga_2O_3$:ZnO=1:1:1 [molar ratio], and In:Ga:Zn=1:1:0.5[atomic ratio]). The deposition condition is set as follows: the distance between the substrate and the target is 100 mm; the pressure is 0.2 Pa; the direct current (DC) power supply is 0.5 kW; and the atmosphere is a mixed atmosphere of argon and oxygen (argon:oxygen=30 sccm:20 sccm and the oxygen flow rate is 40%). Note that a pulse direct current (DC) power supply is preferable because powder substances generated at the time of deposition can be reduced and the film thickness can be made uniform. The In—Ga—Zn—O-based film is formed to a thickness of 5 nm to 200 nm inclusive. In this embodiment, as the oxide semiconductor film, a 20-nm-thick In—Ga—Zn—O-based film is formed by a sputtering method with the use of an In—Ga—Zn—O-based metal oxide target. As the metal oxide target containing In, Ga, and Zn, a metal oxide target having a composition ratio of In:Ga:Zn=1:1:1 (atom) or a target having a composition ratio of In:Ga:Zn=1:1:2 (atom) can also be used.

Examples of a sputtering method include an RF sputtering method in which a high-frequency power source is used as a sputtering power source, a DC sputtering method, and a pulsed DC sputtering method in which a bias is applied in a pulsed manner. An RF sputtering method is mainly used in the case where an insulating film is formed, and a DC sputtering method is mainly used in the case where a metal film is formed.

In addition, there is also a multi-source sputtering apparatus in which a plurality of targets of different materials can be set. With the multi-source sputtering apparatus, films of different materials can be formed to be stacked in the same chamber, or a film of plural kinds of materials can be formed by electric discharge at the same time in the same chamber.

In addition, there are a sputtering apparatus provided with a magnet system inside the chamber and used for a magnetron sputtering, and a sputtering apparatus used for an ECR sputtering in which plasma generated with the use of microwaves is used without using glow discharge.

Furthermore, as a deposition method by sputtering, there are also a reactive sputtering method in which a target substance and a sputtering gas component are chemically reacted with each other during deposition to form a thin compound film thereof, and a bias sputtering in which a voltage is also applied to a substrate during deposition.

Then, the oxide semiconductor film 430 is processed into island-shaped oxide semiconductor layer in a second photolithography step. Note that a resist mask used in the process may be formed by an inkjet method. Formation of the resist mask by an inkjet method needs no photomask; thus, manufacturing cost can be reduced.

Next, dehydration or dehydrogenation of the oxide semiconductor layer is performed. The temperature of first heat treatment for dehydration or dehydrogenation is higher than or equal to 400° C. and lower than or equal to 750° C., preferably higher than or equal to 400° C. and lower than the strain point of the substrate. Here, the substrate is introduced into an electric furnace which is a kind of heat treatment apparatus, heat treatment is performed on the oxide semiconductor layer in a nitrogen atmosphere at 450° C. for one hour, and then, the oxide semiconductor layer are not exposed to the air so that entry of water and hydrogen into the oxide semiconductor layer is prevented; thus, oxide semiconductor layer 431 is obtained (see FIG. 7B).

Note that a heat treatment apparatus is not limited to an electrical furnace, and may include a device for heating an object to be processed by heat conduction or heat radiation from a heating element such as a resistance heating element. For example, an RTA (rapid thermal anneal) apparatus such as a GRTA (gas rapid thermal anneal) apparatus or an LRTA (lamp rapid thermal anneal) apparatus can be used. An LRTA apparatus is an apparatus for heating an object to be processed by radiation of light (an electromagnetic wave) emitted from a lamp such as a halogen lamp, a metal halide lamp, a xenon arc lamp, a carbon arc lamp, a high pressure sodium lamp, or a high pressure mercury lamp. A GRTA apparatus is an apparatus for heat treatment using a high-temperature gas. As the gas, an inert gas which does not react with an object to be processed by heat treatment, such as nitrogen or a rare gas such as argon is used.

For example, as the first heat treatment, GRTA by which the substrate is moved into an inert gas heated to a high temperature as high as 650° C. to 700° C., heated for several minutes, and moved out of the inert gas heated to the high temperature may be performed. With GRTA, high-temperature heat treatment for a short period of time can be achieved.

Note that in the first heat treatment, it is preferable that water, hydrogen, and the like be not contained in the atmosphere of nitrogen or a rare gas such as helium, neon, or argon. It is preferable that the purity of nitrogen or the rare gas such as helium, neon, or argon which is introduced into a heat treatment apparatus be set to be 6N (99.9999%) or higher, preferably 7N (99.99999%) or higher (that is, the impurity concentration is 1 ppm or lower, preferably 0.1 ppm or lower).

The first heat treatment of the oxide semiconductor layer may be performed on the oxide semiconductor film 430 before being processed into the island-shaped oxide semiconductor layer. In that case, after the first heat treatment, the substrate is extracted from the heat treatment apparatus, and then the second photolithography step is performed.

The heat treatment for dehydration or dehydrogenation of the oxide semiconductor layer may be performed at any of the following timings: after the oxide semiconductor layer is formed; after a source layer and a drain layer are formed over the oxide semiconductor layer; and after a protective insulating film is formed over the source layer and the drain layer.

Further, in the case where an opening portion is formed in the gate insulating layer 402, the step of forming the opening portion may be performed either before or after the oxide semiconductor film 430 is subjected to dehydration or dehydrogenation treatment.

Note that the etching of the oxide semiconductor film 430 is not limited to wet etching and dry etching may also be used.

As the etching gas for dry etching, a gas including chlorine (chlorine-based gas such as chlorine ($Cl_2$), boron trichloride ($BCl_3$), silicon tetrachloride ($SiCl_4$), or carbon tetrachloride ($CCl_4$)) is preferably used.

Alternatively, a gas containing fluorine (fluorine-based gas such as carbon tetrafluoride ($CF_4$), sulfur hexafluoride ($SF_6$), nitrogen trifluoride ($NF_3$), or trifluoromethane ($CHF_3$)); hydrogen bromide (HBr); oxygen ($O_2$); any of these gases to which a rare gas such as helium (He) or argon (Ar) is added; or the like can be used.

As the dry etching method, a parallel plate RIE (reactive ion etching) method or an ICP (inductively coupled plasma) etching method can be used. In order to etch the films into desired shapes, the etching conditions (the amount of electric power applied to a coil-shaped electrode, the amount of electric power applied to an electrode on a substrate side, the temperature of the electrode on the substrate side, or the like) are adjusted as appropriate.

As an etchant used for wet etching, a mixed solution of phosphoric acid, acetic acid, and nitric acid, or the like can be used. In addition, ITO07N (produced by KANTO CHEMICAL CO., INC.) may also be used.

The etchant after the wet etching is removed together with the etched materials by cleaning. The waste liquid including the etchant and the material etched off may be purified and the material may be reused. When a material such as indium included in the oxide semiconductor layer is collected from the waste liquid after the etching and reused, the resources can be efficiently used and the cost can be reduced.

The etching conditions (such as an etchant, etching time, and temperature) are appropriately adjusted depending on the material so that the material can be etched into a desired shape.

Next, a metal conductive film is formed over the gate insulating layer 402 and the oxide semiconductor layer 431. The metal conductive film may be formed by a sputtering method or vacuum evaporation. As a material of the metal conductive film, an element selected from aluminum (Al), chromium (Cr), copper (Cu), tantalum (Ta), titanium (Ti), molybdenum (Mo), and tungsten (W), an alloy containing any of these elements as a component, an alloy containing any of these elements in combination, or the like can be given. Alternatively, one or more materials selected from manganese (Mn), magnesium (Mg), zirconium (Zr), beryllium (Be), and yttrium (Y) may be used. Further, the metal conductive film may have a single-layer structure or a stacked structure of two or more layers. For example, the following structures can be given: a single-layer structure of an aluminum film including silicon, a single-layer structure of a copper film, or a film including copper as a main component, a two-layer structure in which a titanium film is stacked over an aluminum film, a two-layer structure in which a copper film is formed over a tantalum nitride film or a copper nitride film, and a three-layer structure in which an aluminum film is stacked over a titanium film and another titanium film is stacked over the aluminum film. Alternatively, a film, an alloy film, or a nitride film which contains aluminum (Al) and one or a plurality of elements selected from titanium (Ti), tantalum (Ta), tungsten (W), molybdenum (Mo), chromium (Cr), neodymium (Nd), and scandium (Sc) may be used.

When heat treatment is performed after the formation of the metal conductive film, it is preferable that the metal conductive film have heat resistance enough to withstand the heat treatment.

A resist mask is formed over the metal conductive film by a third photolithography step and etching is selectively performed, so that a source layer 415*a* and a drain layer 415*b* are formed. Then, the resist mask is removed (see FIG. 7C).

Note that materials and etching conditions are adjusted as appropriate so that the oxide semiconductor layer 431 is not removed by etching of the metal conductive film.

Here, a titanium film is used as the metal conductive film, an In—Ga—Zn—O based oxide is used for the oxide semiconductor layer 431, and an ammonia hydrogen peroxide mixture (a mixed solution of ammonia, water, and a hydrogen peroxide solution) is used.

Note that, in the third photolithography step, only part of the oxide semiconductor layer 431 is etched, whereby an oxide semiconductor layer having a groove (a depressed portion) is formed in some cases. Alternatively, the resist mask used in the process may be formed by an inkjet method. Formation of the resist mask by an inkjet method needs no photomask; thus, manufacturing cost can be reduced.

In order to reduce the number of photomasks used in a photolithography step and reduce the number of photolithography steps, an etching step may be performed with the use of a multi-tone mask which is a light-exposure mask through which light is transmitted to have a plurality of intensities. Since a resist mask formed using a multi-tone mask has a plurality of thicknesses and can be further changed in shape by performing ashing, the resist mask can be used in a plurality of etching steps to provide different patterns. Therefore, a resist mask corresponding to at least two kinds or more of different patterns can be formed by one multi-tone mask. Thus, the number of light-exposure masks can be reduced and the number of corresponding photolithography steps can be also reduced, whereby simplification of a process can be realized.

Next, plasma treatment using a gas such as nitrous oxide ($N_2O$), nitrogen ($N_2$), or argon (Ar) is performed. By this plasma treatment, absorbed water and the like attached to an exposed surface of the oxide semiconductor layer are removed. Plasma treatment may be performed using a mixture gas of oxygen and argon as well.

After the plasma treatment, an oxide insulating layer 416 which serves as a protective insulating film and is in contact with part of the oxide semiconductor layer is formed without exposure to the air.

The oxide insulating layer 416, which has a thickness of at least 1 nm, can be formed as appropriate using a sputtering method or the like, that is a method with which impurities such as water and hydrogen are not mixed into the oxide insulating layer 416. When hydrogen is contained in the oxide insulating layer 416, entry of the hydrogen to the oxide semiconductor layer is caused, whereby a back channel of the oxide semiconductor layer 431 comes to have a lower resistance (to be n-type) and thus a parasitic channel might be formed. Therefore, it is important that a deposition method in which hydrogen is not used is employed in order to form the oxide insulating layer 416 containing as little hydrogen as possible.

Here, a 200-nm-thick silicon oxide film is deposited as the oxide insulating layer 416 by a sputtering method. The substrate temperature in deposition may be from room temperature to 300° C. inclusive and in this embodiment, is 100° C. Formation of a silicon oxide film by a sputtering method can be performed in a rare gas (typically, argon) atmosphere, an oxygen atmosphere, or an atmosphere of a rare gas (typically, argon) and oxygen. As a target, a silicon oxide target or a silicon target can be used. For example, the silicon oxide film can be formed using a silicon target by a sputtering method in an atmosphere of oxygen and nitrogen.

Next, a second heat treatment is performed, in an inert gas atmosphere or oxygen gas atmosphere (preferably at 200° C. to 400° C. inclusive, e.g. 250° C. to 350° C. inclusive). For example, the second heat treatment is performed in a nitrogen atmosphere at 250° C. for one hour. Through the second heat treatment, part of the oxide semiconductor layer (a channel formation region) is heated while being in contact with the oxide insulating layer 416. Thus, oxygen is supplied to part of the oxide semiconductor layer (a channel formation region).

Through the above steps, the oxide semiconductor layer is subjected to the heat treatment for dehydration or dehydrogenation, and then, part of the oxide semiconductor layer (a channel formation region) is selectively made to be in an oxygen excess state. As a result, a channel formation region 413 overlapping with the gate layer 411 becomes i-type, and a source region 414*a* overlapping with the source layer 415*a* and a drain region 414*b* overlapping with the drain layer 415*b* are formed in a self-aligned manner. Through the above-described process, a transistor 410 is formed.

In a gate-bias thermal stress test (BT test) at 85° C. and $2\times10^6$ V/cm for 12 hours, if an impurity (hydrogen and the like) has been in an oxide semiconductor, the bond between the impurity and the main component of the oxide semiconductor is broken by a high electric field (B: bias) and high temperature (T: temperature), so that a generated dangling bond induces a drift in the threshold voltage ($V_{th}$). On the other hand, by removing impurities in an oxide semiconductor as much as possible, especially hydrogen or water and using the high-density plasma CVD apparatus, a dense and high-quality insulating film with high withstand voltage and good interface characteristics between the insulating film and an oxide semiconductor as described above can be obtained; thus, a transistor which is stable even in the BT test can be obtained.

Further, heat treatment may be performed at 100° C. to 200° C. inclusive for one hour to 30 hours in the air. In this embodiment, the heat treatment is performed at 150° C. for 10 hours. This heat treatment may be performed at a fixed heating temperature. Alternatively, the following change in the heating temperature may be conducted plural times repeatedly: the heating temperature is increased from a room temperature to a temperature of 100° C. to 200° C. and then decreased to a room temperature. Further, this heat treatment may be performed before formation of the oxide insulating film under a reduced pressure. Under the reduced pressure, the heat treatment time can be shortened. By the heat treatment, hydrogen is taken in the oxide insulating layer from the oxide semiconductor layer.

By the formation of the drain region 414*b* in part of the oxide semiconductor layer, which overlaps with the drain layer 415*b*, reliability of the transistor can be improved. Specifically, by the formation of the drain region 414*b*, a structure in which conductivity can be varied from the drain layer 415*b* to the channel formation region 413 through the drain region 414*b* can be obtained.

Further the source region or the drain region in the oxide semiconductor layer is formed in the entire thickness direction in the case where the thickness of the oxide semiconductor layer is 15 nm or less. In the case where the thickness of the oxide semiconductor layer is 30 nm to 50 nm inclusive, in part of the oxide semiconductor layer, that is, in a region in the oxide semiconductor layer, which is in contact with the source layer or the drain layer, and the vicinity thereof resistance is reduced and the source region or the drain region is formed, while a region in the oxide semiconductor layer, which is close to the gate insulating layer, can be made to be i-type.

A protective insulating layer may be further formed over the oxide insulating layer 416. For example, a silicon nitride film is formed by an RF sputtering method. Since an RF sputtering method has high productivity, it is preferably used as a deposition method of the protective insulating layer. As the protective insulating layer, an inorganic insulating film which does not include impurities such as moisture, a hydrogen ion, and $OH^-$ and blocks entry of these from the outside is used; for example, a silicon nitride film, an aluminum nitride film, a silicon nitride oxide film, an aluminum oxynitride film, or the like is used. In this embodiment, as the protective insulating layer, a protective insulating layer 403 is formed using a silicon nitride film (see FIG. 7D).

(Variety of Electronic Device on which Active Matrix Display Device is Mounted)

Examples of an electronic device on which the display device disclosed in this specification is mounted are described with reference to FIGS. 8A to 8F.

Figure 8A:
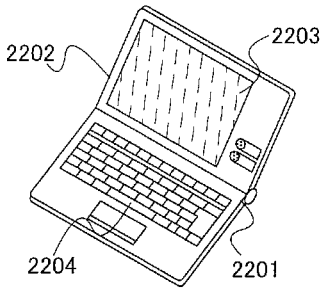
FIGS. 8A to 8F each illustrate an electronic device.

FIG. 8A illustrates a laptop computer, which includes a main body 2201, a housing 2202, a display portion 2203, a keyboard 2204, and the like.

Figure 8B:
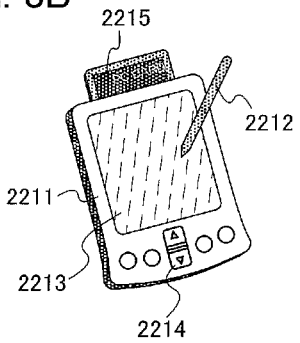

FIG. 8B illustrates a personal digital assistant (PDA), which includes a main body 2211 provided with a display portion 2213, an external interface 2215, an operation button 2214, and the like. A stylus 2212 for operation is included as an accessory.

Figure 8C:
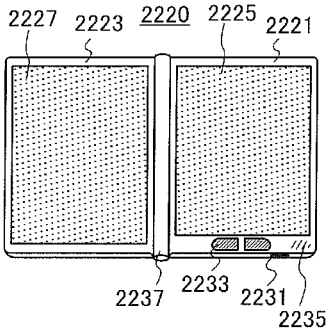

FIG. 8C illustrates an e-book reader 2220 as an example of an electronic paper. The e-book reader 2220 includes two housings, a housing 2221 and a housing 2223. The housings 2221 and 2223 are bound with each other by an axis portion 2237, along which the e-book reader 2220 can be opened and closed. With such a structure, the e-book reader 2220 can be used as paper books.

A display portion 2225 is incorporated in the housing 2221, and a display portion 2227 is incorporated in the housing 2223. The display portion 2225 and the display portion 2227 may display one image or different images. In the structure where the display portions display different images from each other, for example, the right display portion (the display portion 2225 in FIG. 8C) can display text and the left display portion (the display portion 2227 in FIG. 8C) can display images.

Further, in FIG. 8C, the housing 2221 is provided with an operation portion and the like. For example, the housing 2221 is provided with a power supply 2231, an operation key 2233, a speaker 2235, and the like. With the operation key 2233, pages can be turned. Note that a keyboard, a pointing device, or the like may also be provided on the surface of the housing, on which the display portion is provided. Furthermore, an external connection terminal (an earphone terminal, a USB terminal, a terminal that can be connected to various cables such as an AC adapter and a USB cable, or the like), a recording medium insertion portion, and the like may be provided on the back surface or the side surface of the housing. Further, the e-book reader 2220 may have a function of an electronic dictionary.

The e-book reader 2220 may be configured to transmit and receive data wirelessly. Through wireless communication, desired book data or the like can be purchased and downloaded from an electronic book server.

Note that electronic paper can be applied to devices in a variety of fields as long as they display information. For example, electronic paper can be used for posters, advertisement in vehicles such as trains, display in a variety of cards such as credit cards, and the like in addition to e-book readers.

Figure 8D:
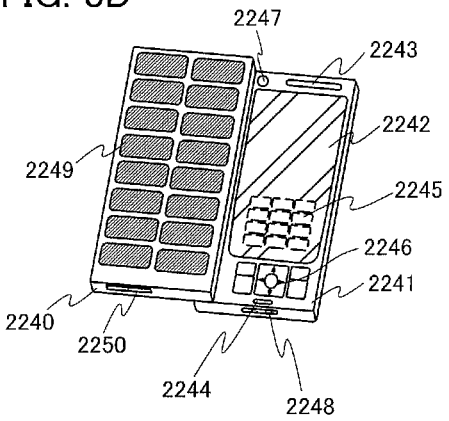

FIG. 8D illustrates a mobile phone. The mobile phone includes two housings: housings 2240 and 2241. The housing 2241 is provided with a display panel 2242, a speaker 2243, a microphone 2244, a pointing device 2246, a camera lens 2247, an external connection terminal 2248, and the like. The housing 2240 is provided with a solar cell 2249 which charges the mobile phone, an external memory slot 2250, and the like. An antenna is incorporated in the housing 2241.

The display panel 2242 has a touch panel function. A plurality of operation keys 2245 which is displayed as images is illustrated by dashed lines in FIG. 8D. Note that the mobile phone includes a booster circuit for increasing a voltage output from the solar cell 2249 to a voltage needed for each circuit. Moreover, the mobile phone can include a contactless IC chip, a small recording device, or the like in addition to the above structure.

The display orientation of the display panel 2242 changes as appropriate in accordance with the application mode. Further, the camera lens 2247 is provided on the same surface as the display panel 2242, and thus it can be used as a video phone. The speaker 2243 and the microphone 2244 can be used for videophone calls, recording, and playing sound, etc. as well as voice calls. Moreover, the housings 2240 and 2241 in a state where they are developed as illustrated in FIG. 8D can be slid so that one is lapped over the other; therefore, the size of the mobile phone can be reduced, which makes the mobile phone suitable for being carried.

The external connection terminal 2248 can be connected to an AC adapter or a variety of cables such as a USB cable, which enables charging of the mobile phone and data communication between the mobile phone or the like. Moreover, a larger amount of data can be saved and moved by inserting a recording medium to the external memory slot 2250. Further, in addition to the above functions, an infrared communication function, a television reception function, or the like may be provided.

Figure 8E:
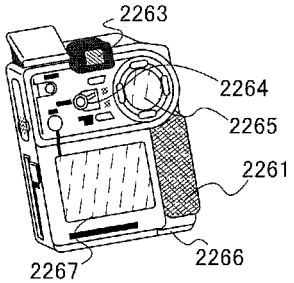

FIG. 8E illustrates a digital camera, which includes a main body 2261, a display portion (A) 2267, an eyepiece 2263, an operation switch 2264, a display portion (B) 2265, a battery 2266, and the like.

Figure 8F:
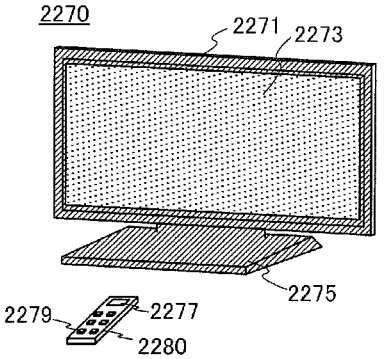

FIG. 8F illustrates a television set 2270, which includes a display portion 2273 incorporated in a housing 2271. The display portion 2273 can display images. Here, the housing 2271 is supported by a stand 2275.

The television set 2270 can be operated by an operation switch of the housing 2271 or a separate remote controller 2280. Channels and volume can be controlled with an operation key 2279 of the remote controller 2280 so that an image displayed on the display portion 2273 can be controlled. Moreover, the remote controller 2280 may have a display portion 2277 in which the information outgoing from the remote controller 2280 is displayed.

Note that the television set 2270 is preferably provided with a receiver, a modem, and the like, A general television broadcast can be received with the receiver. Moreover, when the television set is connected to a communication network with or without wires via the modem, one-way (from a sender to a receiver) or two-way (between a sender and a receiver or between receivers) data communication can be performed.

This application is based on Japanese Patent Application serial no. 2010-029446 filed with Japan Patent Office on Feb. 12, 2010, the entire contents of which are hereby incorporated by reference.

The invention claimed is:

1. A display device comprising:

a signal line to which a data signal is configured to be supplied in a scanning period and an alternating-current driving signal having a lower frequency than the data signal is configured to be supplied in a break period which follows the scanning period and is longer than the scanning period;

a scan line to which a selection signal is configured to be supplied in one horizontal scanning period included in the scanning period and a non-selection signal is configured to be supplied in periods other than the one horizontal scanning period; and a transistor comprising an In—Ga—Zn—O-based oxide semiconductor layer, and having a gate electrically connected to the scan line and one of a source and a drain electrically connected to the signal line, wherein an off-state current of the transistor comprising the In—Ga—Zn—O-based oxide semiconductor layer is smaller than an off-state current of a transistor comprising an amorphous silicon.

2. The display device according to claim 1, wherein one frame period consists of the scanning period and the break period.

3. The display device according to claim 1, further comprising:

a signal line driver circuit configured to control a potential of the signal line; and a controller configured to output the data signal or the driving signal to the signal line driver circuit selectively, wherein the controller comprises:

a data signal generation circuit configured to generate the data signal;

a driving signal generation circuit configured to generate the driving signal; and a switch configured to select, as an output signal of the controller, the data signal in the scanning period and the driving signal in the break period.

4. The display device according to claim 3, wherein the controller comprises:

a reference clock signal generation circuit configured to generate a first clock signal whose frequency is the same as that of the data signal;

a frequency dividing circuit which divides the first clock signal to generate a second clock signal whose frequency is the same as that of the driving signal; and a clock signal selection switch configured to select, as a clock signal used in the signal line driver circuit, the first clock signal in the scanning period and the second clock signal in the break period.

5. The display device according to claim 1, wherein variation in voltage of the driving signal is within a voltage variation range of the data signal.

6. The display device according to claim 1, further comprising:

a capacitor having one terminal electrically connected to the other of the source and the drain of the transistor, and the other terminal electrically connected to a common potential line; and a liquid crystal element having one terminal electrically connected to the other of the source and the drain of the transistor and the one terminal of the capacitor, and the other terminal electrically connected to the common potential line, wherein a potential of the common potential line becomes a driving signal for the common potential line having an opposite polarity to the data signal in the scanning period, and becomes a signal having a fixed potential in the break period.

7. The display device according to claim 1, further comprising:

a capacitor having one terminal electrically connected to the other of the source and the drain of the transistor, and the other terminal electrically connected to a wiring to which a potential of a common potential line is supplied; and a liquid crystal element having one terminal electrically connected to the other of the source and the drain of the transistor and the one terminal of the capacitor, and the other terminal electrically connected to the wiring to which the potential of the common potential line is supplied, wherein the potential of the common potential line becomes a first signal for the common potential line having an opposite polarity to the data signal in the scanning period, and becomes a second signal for the common potential line having the same polarity as the driving signal in the break period.

8. The display device according to claim 7, wherein the driving signal and the second signal for the common potential line is the same signal.

9. A method for driving a display device comprising the steps of:

supplying a data signal to a signal line in a scanning period; and supplying an alternating-current driving signal to the signal line in a break period, wherein the display device comprises the signal line and a transistor comprising an In—Ga—Zn—O-based oxide semiconductor layer, and having one of a source and a drain electrically connected to the signal line, wherein the break period follows the scanning period, wherein the break period is longer than the scanning period, wherein the alternating-current driving signal has a lower frequency than the data signal, and wherein an off-state current of the transistor comprising the In—Ga—Zn—O-based oxide semiconductor layer is smaller than an off-state current of a transistor comprising an amorphous silicon.

10. The method for driving a display device according to claim 9, further comprising the steps of:

supplying a selection signal to a scan line in one horizontal scanning period included in the scanning period; and supplying a non-selection signal to the scan line in periods other than the one horizontal scanning period.

11. The method for driving a display device according to claim 9, wherein variation in voltage of the alternating-current driving signal is within a voltage variation range of the data signal.

12. The method for driving a display device according to claim 9, further comprising the steps of:

supplying a common potential having an opposite polarity to the data signal to a common potential line in the scanning period; and supplying a signal having a fixed potential to the common potential line in the break period, wherein the common potential line is electrically connected to one terminal of a liquid crystal element and one terminal of a capacitor, and wherein the other terminal of the liquid crystal element and the other terminal of the capacitor are electrically connected to the other one of the source and the drain.

13. The method for driving a display device according to claim 9, further comprising the steps of:

supplying a first common potential having an opposite polarity to the data signal to a common potential line in the scanning period; and supplying a second common potential having the same polarity as the driving signal to the common potential line in the break period, wherein the common potential line is electrically connected to one terminal of a liquid crystal element and one terminal of a capacitor, and wherein the other terminal of the liquid crystal element and the other terminal of the capacitor are electrically connected to the other one of the source and the drain.

* * * * *